US011994369B2

(12) United States Patent
Smith et al.

(10) Patent No.: US 11,994,369 B2
(45) Date of Patent: May 28, 2024

(54) VEHICLE WITH A CONDUCTED ELECTRICAL WEAPON

(71) Applicant: Axon Enterprise, Inc., Scottsdale, AZ (US)

(72) Inventors: Patrick W. Smith, Scottsdale, AZ (US); Magne Nerheim, Paradise Valley, AZ (US); Brandy Shaffer, Scottsdale, AZ (US); Gabriel Othman, Seattle, WA (US); Matthew Carver, Scottsdale, AZ (US); Brian Slaughter, Scottsdale, AZ (US); Brian Fairbanks, Scottsdale, AZ (US); Mark Eastwood, Scottsdale, AZ (US); Jackson Dewitt, Scottsdale, AZ (US); Oleg Nemtyshkin, Scottsdale, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 374 days.

(21) Appl. No.: 17/423,265

(22) PCT Filed: Jan. 17, 2020

(86) PCT No.: PCT/US2020/014055

§ 371 (c)(1),
(2) Date: Jul. 15, 2021

(87) PCT Pub. No.: WO2020/154191

PCT Pub. Date: Jul. 30, 2020

(65) Prior Publication Data

US 2022/0082357 A1 Mar. 17, 2022

Related U.S. Application Data

(60) Provisional application No. 62/891,149, filed on Aug. 23, 2019, provisional application No. 62/839,339, (Continued)

(51) Int. Cl.
*F41H 13/00* (2006.01)

(52) U.S. Cl.
CPC ..... *F41H 13/0025* (2013.01)

(58) Field of Classification Search
CPC .. F41H 13/00; F41H 13/0012; F41H 13/0025; H05C 1/00; H05C 1/04
See application file for complete search history.

(56) References Cited

U.S. PATENT DOCUMENTS 2,926,566 A 3/1960 Atkins et al.
5,831,199 A 11/1998 McNulty, Jr. et al.

(Continued)

FOREIGN PATENT DOCUMENTS

CN 207351302 U 5/2018
CN 108444337 A 8/2018

(Continued)

OTHER PUBLICATIONS

European Patent Office, Extended European Search Report for European Application No. 20745675.7 dated Dec. 5, 2022.

(Continued)

*Primary Examiner* — Adolf D Berhane
(74) *Attorney, Agent, or Firm* — Justin Powley

(57) ABSTRACT

A payload conducted electrical weapon ("CEW") may include a housing configured to house at least a plurality of electrodes and a signal generator. The payload CEW may be removably inserted into a bay of a launcher. The launcher may be mounted on a vehicle. The plurality of electrodes may be configured to be launched from the housing. The housing may be configured to be launched from the bay of the launcher simultaneously with or after the plurality of electrodes are launched. The signal generator may be configured to transmit a stimulus signal through the plurality of electrodes. The signal generator may be configured to trans- (Continued)

mit the stimulus signal before, during, and/or after the housing is launched.

20 Claims, 10 Drawing Sheets

Related U.S. Application Data filed on Apr. 26, 2019, provisional application No. 62/794,140, filed on Jan. 18, 2019.

(56) References Cited

U.S. PATENT DOCUMENTS

| | | | |
|---|---|---|---|
| 5,962,806 | A | 10/1999 | Coakley et al. |
| 6,269,726 | B1 | 8/2001 | McNulty, Sr. |
| 6,877,434 | B1 | 4/2005 | McNulty, Jr. |
| 7,950,176 | B1 | 5/2011 | Nemtyshkin et al. |
| 7,950,329 | B1 | 5/2011 | Nemtyshkin et al. |
| 8,342,098 | B2 | 1/2013 | Shalev et al. |
| 8,549,783 | B2 | 10/2013 | Marquez |
| 10,066,906 | B2 * | 9/2018 | Heroor ..... H04L 63/0876 |
| 10,168,127 | B1 | 1/2019 | Salisbury et al. |
| 10,598,467 | B1 | 3/2020 | McDermit et al. |
| 11,041,698 | B2 | 6/2021 | Nemtyshkin et al. |
| 2006/0207466 | A1 | 9/2006 | McNulty et al. |
| 2006/0292528 | A1 | 12/2006 | Keely et al. |
| 2010/0050856 | A1 | 3/2010 | Baldwin |
| 2010/0275806 | A1 | 11/2010 | Gavin et al. |
| 2011/0067562 | A1 | 3/2011 | Cilia et al. |
| 2012/0039013 | A1 | 2/2012 | Brundula et al. |
| 2015/0002981 | A1 | 1/2015 | Klug et al. |
| 2017/0059661 | A1 | 3/2017 | Foldyna |
| 2017/0241751 | A1 | 8/2017 | Nerheim |
| 2018/0257774 | A1 | 9/2018 | Volpi |
| 2018/0283829 | A1 | 10/2018 | Petrovic et al. |
| 2019/0128650 | A1 | 5/2019 | Kim |
| 2020/0109933 | A1 | 4/2020 | Brundula et al. |
| 2023/0288174 | A1 * | 9/2023 | Salisbury ..... F41H 13/0025 89/1.11 |

FOREIGN PATENT DOCUMENTS

| | | | |
|---|---|---|---|
| KR | 101890759 | B1 | 3/2018 |
| KR | 101872709 | B1 | 7/2018 |
| RU | 2275576 | C1 | 4/2006 |
| RU | 68671 | U1 | 11/2007 |
| RU | 2351871 | C1 | 4/2009 |
| RU | 2477441 | C1 | 3/2013 |
| RU | 2480704 | C2 | 4/2013 |
| RU | 2526159 | C2 | 8/2014 |
| RU | 2527242 | C2 | 8/2014 |
| RU | 2648562 | C1 | 3/2018 |
| WO | 2009025575 | A1 | 2/2009 |

OTHER PUBLICATIONS

International Patent Office, International Search Report for International Application No. PCT/US20/14055, dated Jul. 28, 2020, p. 1-14.

* cited by examiner

VEHICLE WITH A CONDUCTED ELECTRICAL WEAPON

CROSS REFERENCE TO RELATED APPLICATIONS

This application claims priority to, and the benefit of, International Patent Application No. PCT/US20/14055, filed Jan. 17, 2020, and entitled "VEHICLE WITH A CONDUCTED ELECTRICAL WEAPON," which claimed priority to, and the benefit of, U.S. Provisional Patent Application No. 62/794,140, filed Jan. 18, 2019, and entitled "VEHICLE WITH A CONDUCTED ELECTRICAL WEAPON," U.S. Provisional Patent Application No. 62/839,339, filed Apr. 26, 2019, and entitled "VEHICLE WITH A CONDUCTED ELECTRICAL WEAPON," and U.S. Provisional Patent Application No. 62/891,149, filed Aug. 23, 2019, and entitled "VEHICLE WITH A CONDUCTED ELECTRICAL WEAPON," each of which are hereby incorporated by reference in their entirety.

FIELD

Embodiments of the present disclosure relate to a vehicle having a conducted electrical weapon.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Figure 1A:
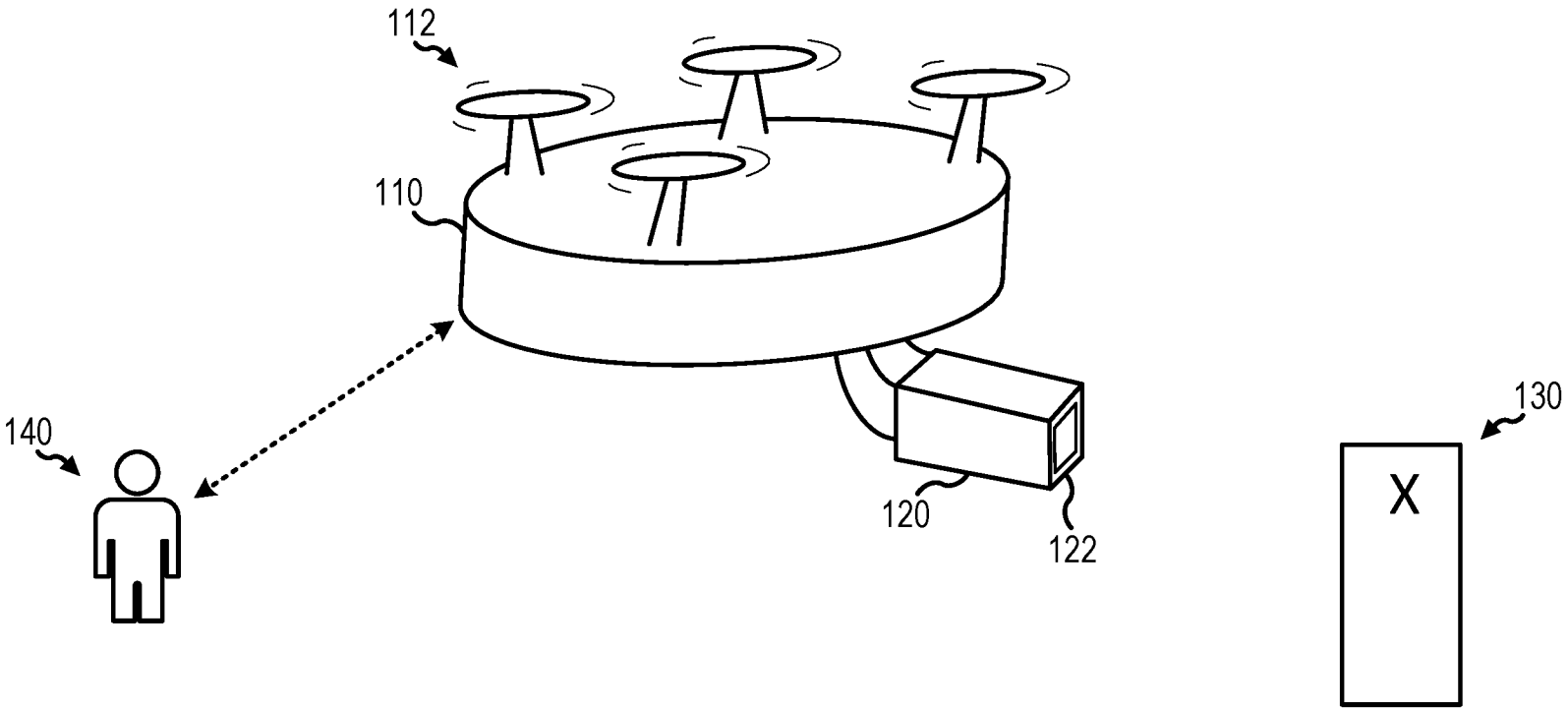
FIGS. 1A and 1B illustrate vehicles having a payload conducted electrical weapon (CEW), in accordance with various embodiments.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

A conducted electrical weapon ("CEW") may include wire-tethered electrodes (e.g., darts, probes, etc.) that are launched toward a target (e.g., an animal target, a human target, etc.) in a manner configured to be electrically coupled to the target to provide a stimulus signal through the target. Providing a stimulus signal through the target (e.g., through tissue of the target) may impede locomotion of the target.

In a hand-held CEW, a cartridge holds electrodes for launching toward the target. The cartridge may include a pyrotechnic for launching the electrodes toward the target. In certain embodiments, the cartridge is inserted into a bay of the handle to cooperate with the handle to launch the electrodes and provide the stimulus signal through the target. The handle includes a user interface (e.g., safety, trigger, firing control, etc.) that enables the user of the CEW to launch the electrodes from the cartridge. The handle also includes a power supply (e.g., battery, etc.) that provides the energy for the stimulus signal and a signal generator that converts the energy from the power supply into a stimulus signal (e.g., a pulsed current).

In response to one or more of the electrodes being launched, a user may remove the cartridge, or cartridges if there are more than one, from the bay, or bays, in the handle and insert new, unfired cartridges. Electrodes may be launched from the new cartridges to disable the same or other targets.

The range of a CEW that delivers a stimulus signal via wire-tethered electrodes is limited by the length of the wire tethers. In the case of a hand-held CEW, the wire tethers extend from the device to the electrodes as they strike the target so that the stimulus signal from the signal generator (within the device) can travel through the wire tethers to and through the target. Because a user generally holds the handle while operating the CEW, the range of the CEW from the user to the target is limited by the length of the wire-tethers.

In accordance with various embodiments, a CEW (e.g., payload CEW, entire launch CEW, complete launch CEW, etc.) may operate as a payload of a vehicle (e.g., drone, robot, car, etc.) to increase the range of a wire-tethered CEW. In various embodiments, a vehicle may comprise any object capable of traveling by land, water, or air. For example, a vehicle may comprise an autonomous vehicle. For example, a vehicle may comprise an unmanned aerial vehicle (UAV) (e.g., a drone), an unmanned ground vehicle (UGV), an unmanned surface vessel (USV) (e.g., unmanned surface vehicle, autonomous surface vehicle, etc.), a robot, a car, or the like. A ground vehicle may comprise one or more wheels, a continuous track (e.g., tank tread, caterpillar track, etc.), or the like configured to enable movement of the vehicle on land-based terrain.

A vehicle may carry a payload CEW any distance away from a user (e.g., the user operating the vehicle) toward a target. A vehicle may carry a payload CEW many times further away from a user than the length of the wire tethers that provide a stimulus signal through a target (e.g., in comparison to a hand-held CEW). In various embodiments, the vehicle may operate to position a payload CEW within close range of a target. For example, in one embodiment, a vehicle (either remotely or locally operated) may be positioned within a closer range of a target than a human may safely be positioned. In one embodiment, a vehicle may be positioned 5 ft (1.524 m) or 10 ft (3.048 m) from a target. In yet other embodiments, a vehicle may be positioned more than 100 ft (30.48 m) from a target, and even up to 400 ft (121.92 m) from the target. A person having ordinary skill in the art will appreciate that these distances are merely exemplary, and other distances, either higher or lower than the indicated distances, may be implemented in accordance with the teachings herein.

In accordance with various embodiments, a payload CEW may be launched from a launcher (e.g., payload launcher, CEW payload launcher) toward a target. A vehicle may carry the launcher away from an operating user over a distance toward a target. The vehicle may bring the payload CEW into (e.g., within) a range with (e.g., of) a target. As discussed above, the phrase "in range" or "within a range" means within the distance of the length of the wire tethers of the electrodes of the payload CEW. Once the vehicle is in range of the target, the launcher may launch the payload CEW toward the target. Two or more electrodes of the payload CEW may electrically couple to the target to provide a stimulus signal through the target to impede locomotion of the target.

In various embodiments, the decision to launch electrodes from the payload CEW, or the housing of the payload CEW, as discussed further herein, is received from a human operator. In that respect, although a vehicle carrying the payload CEW may be at least partially autonomous, the decision to launch electrodes may involve human intervention.

Any systems (e.g., camera, guidance, global positioning system (GPS), object detection, communications, speaker, microphone, etc.) used to control and/or direct the flight or movement of a vehicle may be used to bring the vehicle within range of a target, aim the launcher toward the target, and/or control launch of the payload CEW.

In various embodiment, a payload CEW includes all the components needed to launch electrodes, provide a stimulus signal through the electrodes, and launch the remaining components of the payload CEW (e.g., all components minus the electrodes already launched). For example, a payload CEW may include a power supply and a signal generator. The components of a payload CEW may be held (e.g., contained) on or in a housing. The electrodes may be launched from the housing. The housing may be launched from the launcher to launch, serially, components of the payload CEW.

Figure 5:
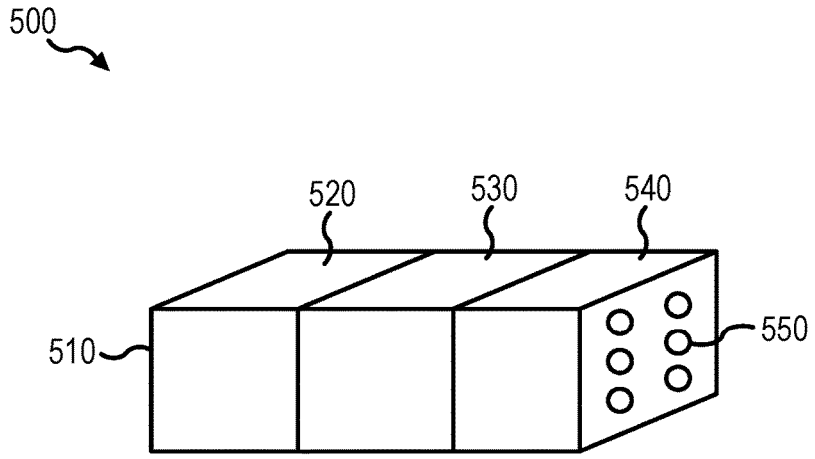
FIGS. 5 and 6 illustrate exemplary payload CEWs, in accordance with various embodiments.

For example, and in accordance with various embodiments, FIG. 5 depicts an exemplary payload CEW 500. Payload CEW 500 includes a housing, such as housing 510. Payload CEW 500 may comprise two or more wire-tethered electrodes (see portion 540), a pyrotechnic for launching the electrodes (not shown), a pyrotechnic for launching the housing (see portion 520), and electronics (e.g., power supply, signal generator, launch controller, processing circuit, interface to launcher, etc.) (see portion 530) needed to launch the electrodes, launch the housing from the launcher, and/or provide a stimulus signal through a target via the wire-tethered electrodes. Housing 510 may be configured to house (e.g., holds, encloses, etc.) the two or more wire-tethered electrodes, the pyrotechnic for launching the electrodes, the pyrotechnic for launching the housing, and the electronics. Housing 510 may be insertable into a launcher of a vehicle. Housing 510 may be launched from the launcher to launch, serially, components of payload CEW 500.

In various embodiments, and with reference to FIG. 1A, a drone 110 is disclosed. Drone 110 may comprise any suitable unmanned aerial vehicle (UAV) capable of aerial travel. For example, drone 110 may comprise one or more propellers 112 configured to convert rotational motion into thrust to enable drone 110 to aerially traverse. Each propeller 112 may be coupled to a motor configured to apply a force to the propellers 112 to cause each propeller 112 to rotate. Drone 110 may comprise an autonomous vehicle or may be controlled remotely by an operator (e.g., user 140). Drone 110 may comprise a payload CEW 122. Payload CEW 122 may be similar to any payload CEW described herein. Payload CEW 122 may be provided on a launcher, such as launcher 120. In one embodiment, a payload CEW 122 may be inserted into a bay (e.g., see bay 321 of FIG. 3) of launcher 120. Launcher 120 is mounted to drone 110. Launcher 120 may be mounted on drone 110 at any suitable location capable of deploying payload CEW 122. Drone 110 may be maneuvered within range of a target 130. Launcher 120 and/or drone 110 may comprise one or more additional systems (e.g., camera, guidance, global positioning system (GPS), object detection, communications, speaker, microphone, etc.) used to control and/or direct the flight or movement of drone 110, bring drone 110 within range of target 130, aim launcher 120 toward target 130, and/or control launch of payload CEW 122. Once drone 110 brings payload CEW 122 within range of target 130, launch of payload CEW 122 may be initiated. In one embodiment, a user 140 may initiate and/or confirm launch of payload CEW 122.

Figure 1B:
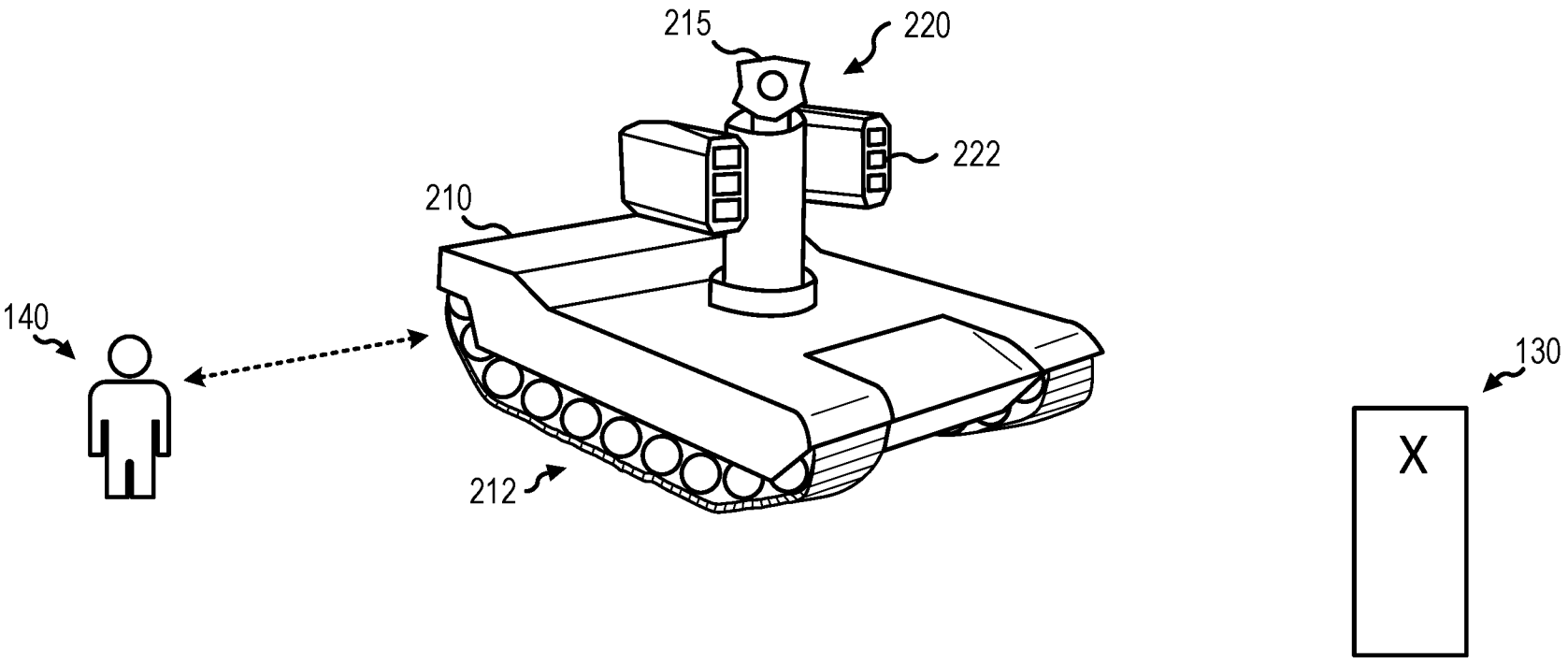

In various embodiments, and with reference to FIG. 1B, an unmanned ground vehicle (UGV) 210 is disclosed. UGV 210 may comprise any suitable vehicle capable of operating on land surfaces, such as, for example a car, a tank, or the like. For example, UGV 210 may comprise a land traversal means 212 such as, for example, wheels, tracks, or the like. UGV 210 may comprise an autonomous vehicle or may be controlled remotely by an operator (e.g., user 140). UGV 210 may comprise a payload CEW 222. Payload CEW 222 may be similar to payload CEW 122, with brief reference to FIG. 1A, and/or any other payload CEW described herein. Payload CEW 222 may be inserted into a bay of a launcher 220. Launcher 220 may be similar to launcher 120, with brief reference to FIG. 1A, and/or any other launcher described herein. In various embodiments, a plurality of payload CEWs 222 may be inserted into one or more bays of launcher 220. Launcher 220 may be mounted on an outer surface of UGV 210. Launcher 220 may be mounted on UGV 210 at any suitable location capable of deploying payload CEW 222. Launcher 220 may comprise one or more additional systems (e.g., camera, guidance, global positioning system (GPS), object detection, communications, speaker, microphone, etc.) used to control and/or direct the flight or movement of UGV 210, bring UGV 210 within range of target 130, aim launcher 220 toward target 130, and/or control launch of payload CEW 222. For example, as depicted in FIG. 1B, UGV 210 may comprise a guidance system 215, which may include a camera and/or any other visual guidance components. Once UGV 210 brings payload CEW 222 within range of target 130, launch of payload CEW 222 may be initiated. In one embodiment, a user 140 may initiate and/or confirm launch of payload CEW 222.

A person of ordinary skill in the art will appreciate that a vehicle, such as drone 110 (with brief reference to FIG. 1A)

or UGV 210 (with brief reference to FIG. 1B), will have a processor and a non-transitory computer-readable medium comprising computer-executable instructions that when executed by a processor, perform one or more actions. The non-transitory computer-readable medium may be a tangible, non-transitory memory configured to communicate with the processor. In one embodiment, non-transitory computer-readable medium contains computer-executable instructions that allow navigation of the vehicle. The medium may comprise instructions that when executed by a processor allow the reception and translation of electronic instructions from a remote user or system. Yet in other embodiments, a medium may contain instructions that when executed by a processor allow for onboard systems to at least partially navigate the vehicle, either directly in response to a local user (e.g., driver/flyer, user 140, etc.) or responsive to one or more electronic inputs or outputs (e.g., sensor outputs). Those skilled in the art will appreciate that one or more processors and/or computer-readable mediums may be provided as part of any component recited herein.

In various embodiments, a system (e.g., a payload system, a payload CEW system, a vehicular payload system, etc.) may include a vehicle, a launcher, and a payload CEW (e.g., as depicted in FIGS. 1A and 1B). The launcher may be coupled to an outer surface of the vehicle. The payload CEW may be removably inserted within a bay the launcher. In that respect, it should be understood by one having skill in the art that the figures, disclosure, and teachings discussed herein with respect to a vehicle and/or a payload CEW may also be applied to a system having a vehicle, a launcher, and a payload CEW.

Figure 2:
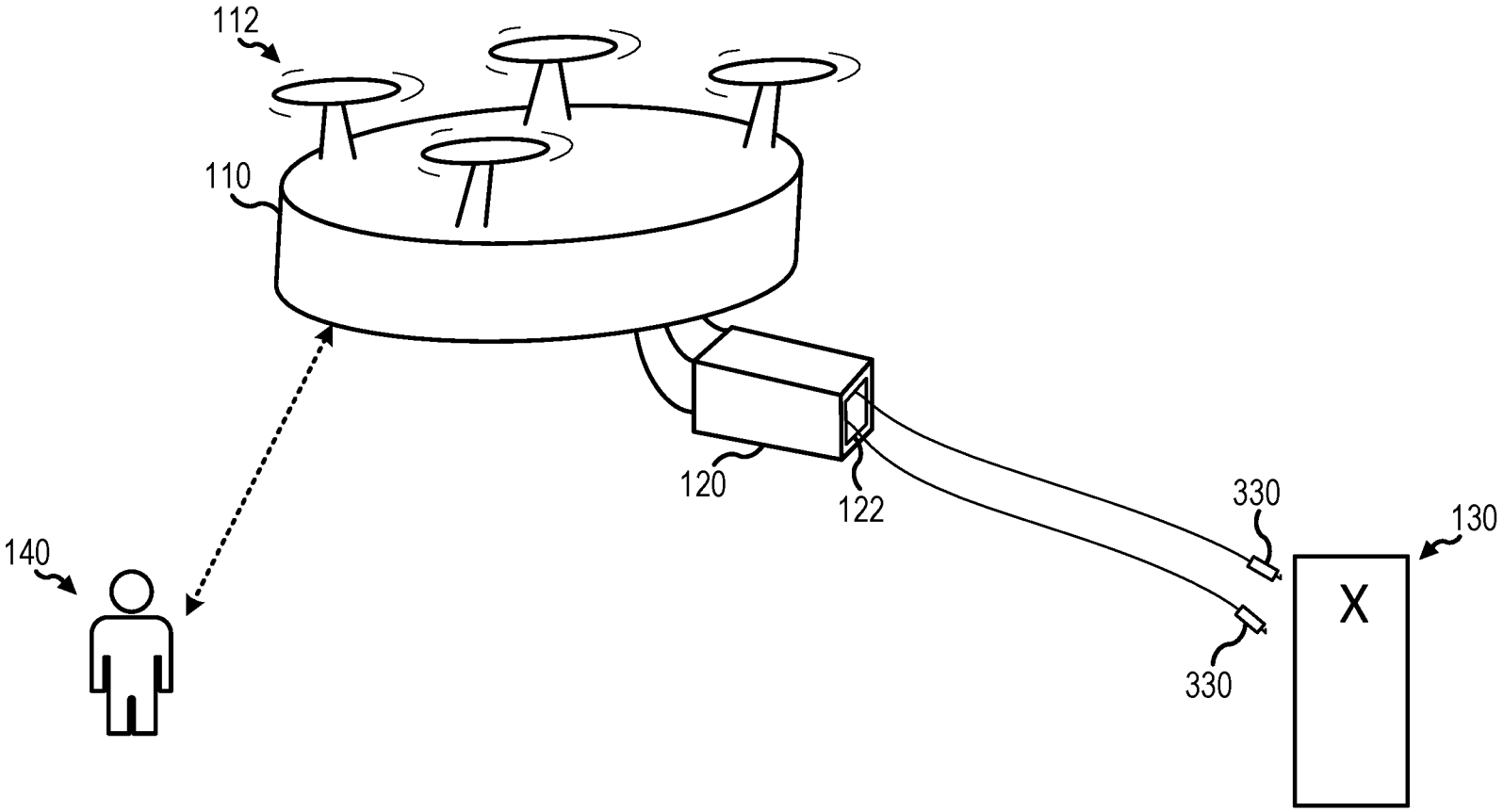
FIG. 2 illustrates a vehicle deploying electrodes from a payload CEW, in accordance with various embodiments.
Figure 3:
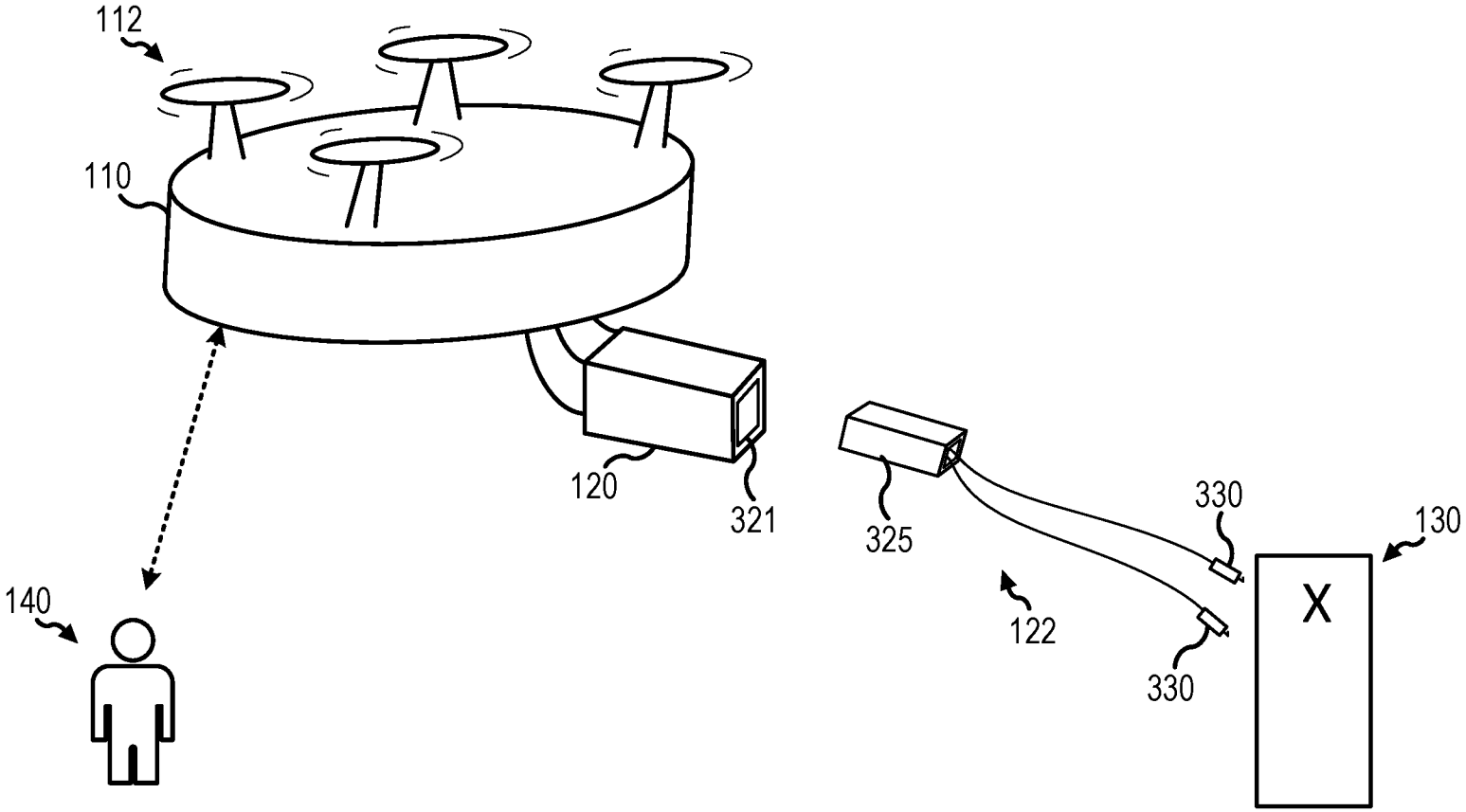
FIG. 3 illustrates a vehicle deploying a housing of a payload CEW, in accordance with various embodiments.
Figure 4:
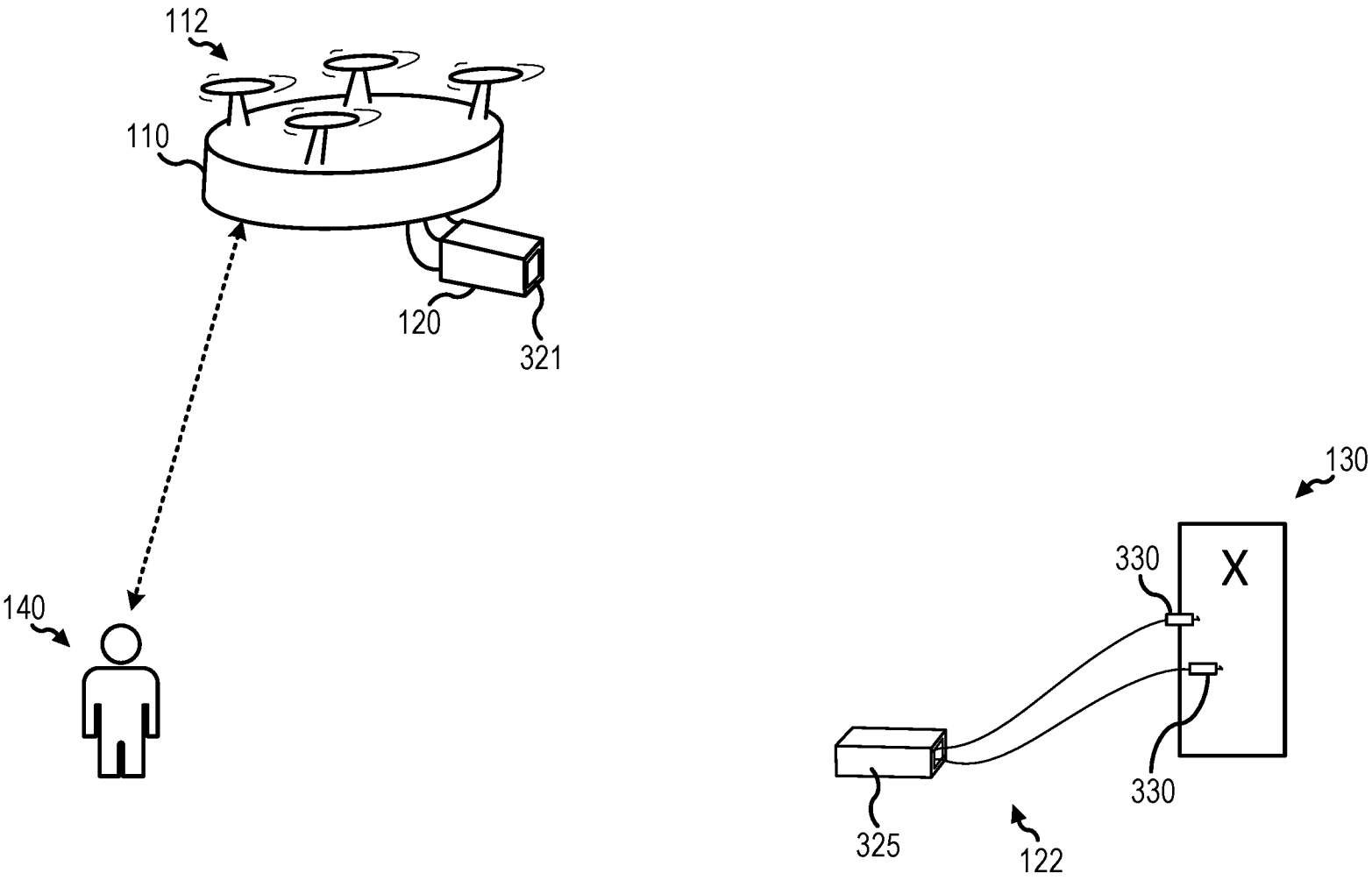
FIG. 4 illustrates electrodes deployed from a payload CEW of a vehicle contacting a target, in accordance with various embodiments.

With specific reference to FIGS. 2-4, an example initiation of launching a payload CEW, such as for example, payload CEW 122, is disclosed. In accordance with one embodiment, initiating launch of payload CEW 122 launches two or more electrodes 330 (e.g., wire-tethered electrodes) from payload CEW 122. After electrodes 330 have been launched, the remainder of payload CEW 122 (e.g., housing 325) may be launched from launcher 120, either immediately or at a later time. In one embodiment, housing 325 and two or more electrodes 330 may be ejected or directed toward target 130. Two or more electrodes 330 electrically couple to target 130. Housing 325 lands on the ground (e.g., a surface) within wire-tether length distance (e.g., within range) of target 130. Electronics in housing 325 provide a stimulus signal through target 130 to impede locomotion of the target.

Electronics in housing 325 may continue to provide a stimulus signal through target 130 after the two or more electrodes 330 have been launched. The electronics in housing 325 may be reactivated to provide additional stimulus signals until the energy in the power supply in housing 325 is depleted. In one embodiment, a user (e.g., user 140) may remotely determine when and/or how much stimulus to provide.

When a hand-held CEW is used, the user may determine whether the target needs additional stimulus signals simply by observing the target. In one embodiment in which a remote user (e.g., user 140) may determine whether to adjust the stimulus (e.g., increase or decrease the duration and/or amount) transmitted to a target (e.g., target 130) via a vehicle (e.g., drone 110, UGV 210, etc.), an image capturing device (e.g., video or still camera) may capture images of the target, which may be transmitted to one or more remote users. The images may be transmitted to the one or more remote users in real time or near real time. In one embodiment, the image capturing device may be on the vehicle, such as drone 110 or UGV 210. In another embodiment, the image capturing device may be located on another vehicle (manned or remote) and/or on a body worn camera. A payload CEW that is a distance away from the user may also be reactivated remotely. Reactivation may be controlled, at least partially, by circuitry in the payload CEW and/or remotely by the user. In one embodiment, circuitry in the payload CEW may detect motion of the target and prompt a user to reactivate upon detecting motion. A payload CEW may issue pre-programmed commands (e.g., do not move) to a target via a speaker. A payload CEW may also comprise a speaker, and may be configured to issue sounds or commands relayed by the user. A payload CEW may provide additional stimulus signals in cooperation with the pre-programmed commands.

A user may use the systems of the vehicle to monitor a target and to remotely activate the payload CEW to provide additional stimulus signals through the target. In an implementation, a camera on a vehicle may be used to visually monitor one or more targets. A user may remotely reactivate one or more payload CEWs to provide additional stimulus signals in response to monitoring the targets via the camera. The systems of the vehicle may be further used to communicate with a target. For example, a remote user may utter an audible command that is transmitted to the vehicle and then relayed to the target via a speaker in the vehicle. The target may utter an audible response that is captured by a microphone on the vehicle, transmitted to the user, and played back to the user via a speaker in the vehicle controller.

In one embodiment, the vehicle may land, otherwise touchdown, or travel on a surface within a proximity threshold of the target. Landing and/or being within a proximity threshold of the target (even while in the air in some embodiments), and/or traversing proximate the target, may allow the vehicle (and/or the user) to monitor vital signs, preserve energy, perform surveillance, such as closely observing surrounding weapons and/or threats, and/or perform similar operations. The vehicle may patrol (either from a surface or while still in motion) for external threats, such as additional suspects and/or targets. In one embodiment, a communication device, such as an audio, visual, and/or audio-visual device may be positioned for clear visibility/communication with or of the target. In one embodiment, a 360-degree camera may be used for searching a plurality of directions for incoming threats (e.g., guidance system 215 of UGV 210, with brief reference to FIG. 1B).

A plurality of vehicles may be used in accordance with various embodiments. For example, a first vehicle may be configured to launch one or more non-lethal projectiles, such as a CEW configured to induce NMI, and a second vehicle may be configured to launch one or more non-lethal projectiles, wherein at least one projectile on the second vehicle is not on the first vehicle. In one embodiment, the second vehicle may comprise a projectile configured to administer a tranquilizer. In another embodiment, at least one vehicle may be configured to administer ketamine. In one embodiment, dosing of the administered tranquilizer and/or ketamine, or similar substance, may be determined based on one or more calculations determined by one of the vehicles, and/or from sensor data obtained from the vehicle. In one embodiment, the second vehicle may be launched from the first vehicle. In one embodiment, the first vehicle and the second vehicle are launched from a common third vehicle or device.

In various embodiments, a single vehicle may be configured to administer a plurality of different non-lethal payloads. For example, one vehicle may contain a CEW, a tranquilizer, and/or other non-lethal payloads. In one embodiment, at least one projectile has unique identification features to allow confirmation of which drone, cartridge, agency, etc. deployed or administered the specific projectile.

As previously discussed herein, a payload CEW may be launched in stages. In one embodiment, the electrodes of a payload CEW may be launched in advance of launching the remainder of the payload CEW. A payload CEW may include all components for launching two or more electrodes, launching the remainder of the payload CEW, and/or providing one or more stimulus signals through a target. Electrodes of the payload CEW may be wire-tethered to the housing of the payload CEW, therefore, a vehicle (e.g., drone 110, UGV 210, etc.) may bring the launcher to within the length of the wire tethers of the target (e.g., in range) before the electrodes and/or the housing are launched.

The electrodes may be launched toward a target, followed by the launch of at least a portion of the housing or other portion of the payload. For example, the electrodes may be launched from the housing at (or during) a first launch. The housing, or a portion of the housing or payload CEW, may be launched from the launcher at (or during) a second launch. The second launch may occur simultaneously with the first launch. The second launch may occur after the first launch.

In various embodiments, at some time following the launch of the electrodes, at least a portion of the housing is also launched from the launcher. The amount of time between the first launch of the electrodes and the second launch of the housing may be brief. For example, the pyrotechnic or mechanism that launches the electrodes may be initiated or ignited so that the rapidly expanding gas from the pyrotechnic begins to push the electrodes from their respective bores. While the electrodes are still moving out of the bores or shortly after the electrodes have moved out of the bores, the pyrotechnic for launching the housing may be ignited. The force provided by the pyrotechnic that launches the housing and the electrodes respectively may enable the electrodes to move at a higher velocity than the housing, so that the electrodes deploy from the housing, fly toward the target, and couple to (e.g., attach to, embed into, etc.) the target while the housing follows the electrodes toward the target at a lesser velocity to land (e.g., on the ground) within wire tether range of the target. In yet other embodiment, such as with close range targeting, the force may be used to reduce the respective velocity of the electrodes toward the target.

The housing may be launched from the launcher at any time after launch of two or more electrodes with the result that the electrodes couple to the target and the housing lands within wire tether range of the target. In various embodiments, the electrodes fully deploy from the housing of the payload CEW and are in flight toward the target before the housing is launched toward the target. In various embodiments, the electrodes are launched from the housing of the payload CEW, couple to the target, and begin to provide the stimulus signal through the target before the remainder of the payload CEW is launched from the launcher.

In various embodiments, FIGS. 1A and 2-4 depict an example sequence or stages of launching a payload CEW. Although FIGS. 2-4 depict the example launching from a drone 110, it should be understood by one having skill in the art that the teachings of FIGS. 2-4 and the accompanying description may also be applied to any other suitable vehicle, such as, for example, a UAV, a UGV (e.g., UGV 210), a USV, and/or the like.

Launcher 120 is shown coupled to drone 110. While launcher 120 is depicted as being beneath drone 110, in other embodiments it may extend from the top or sides of a vehicle. Launcher 120 may be positioned on a gimble and/or other apparatus. Launcher 120 may be coupled to the vehicle using any suitable technique. Launcher 120 may be removably coupled to the vehicle. For example, an outer surface of the vehicle may comprise a rail interface system, an accessory rail, or the like, such as a Weaver rail, a Picatinny rail (e.g., MIL-STD-1913 rail, STANAG 2324 rail, etc.), or the like. Launcher 120 may comprise a slot, or similar physical characteristic or feature, configured to interface with the rail interface system to removably couple launcher 120 to the vehicle. In that respect, use of the rail interface system may enable launcher 120 to be movable and interoperable between vehicles (e.g., drone 110, UGV 210, etc.), weapons (e.g., a firearm, a weapon comprising a rail interface system, etc.), and/or any other apparatus comprising a rail interface system.

Payload CEW 122 may be loaded in (e.g., inserted partially or wholly into) launcher 120. A launcher may hold one or more payload CEWs. A launcher, such as launcher 120, may launch payload CEW 122 independent of the operation of drone 110. Drone 110 may be maneuvered to within wire tether range of target 130. One or more systems or users may be used to maneuver. In this regard, a person of ordinary skill in the art will appreciate that any vehicle disclosed herein, including but not limited to drone 110, will have a processor and a non-transitory computer-readable medium comprising computer-executable instructions that when executed by a processor, perform one or more actions. One or more of the same systems (e.g., cameras, infrared sensors, navigation system, flight control system, etc.) that control the vehicle may be used (either via AI, computer-executable instructions, and/or via a local or remote user) to identify and fly toward a target. For example, drone 110 may include a camera that provides an image of the area around the drone to user 140 via a communications system. The image of the area around the drone may be presented on a display of the controller that is used by user 140 to at least partially control drone 110.

Any technique may be used to identify and/or track a target. Any technique may be used to aim a payload CEW toward a target. For example, a target may be identified by a user. A user may identify a target visually and/or a target may be identified by object recognition performed by the electronics on the vehicle or by one or more remote electronic devices, such as for example, based on images provided by the vehicle. A vehicle may automatically track a target after identification. A user may use images provided by another vehicle, including but not limited to another drone, to control the vehicle to track a target.

A vehicle may include a sensor (e.g., detector) configured to detect a distance between the vehicle and a target. A sensor may detect when the vehicle is within range of a target for launching a payload CEW. Once within range of a target, a payload CEW may be automatically or manually aimed toward a target. Automatic aiming may include target recognition and aligning launcher 120 with the target. A user may manually aim a payload CEW toward a target by analyzing images provided by the vehicle. A vehicle and/or a launcher may include an aiming device (e.g., pointer) to identify locations on a target where one or more electrodes are likely to land after launch. An image provided by a vehicle may include images of the locations on the target as identified by the aiming device to aid manual or automatic aiming, which may in certain embodiments be provided to one or more remote users.

With specific reference to FIG. 2, drone 110 has been brought within range of target 130. Launcher 120 has been aimed toward target 130. A command may be transmitted to launcher 120, or drone 110, to launch payload CEW 122 toward target 130. For example, in one embodiment, user 140 may transmit an electronic signal configured to initiate launching payload CEW 122 from drone 110. In various embodiments, actual launch may also be triggered (e.g., launched) automatically upon arriving within range (or within a smaller range or area of acceptable likelihood of hitting the target), such as after user 140 has issued the command to launch, and launcher 120 being aimed at target 130. A launch command initiates the launch of two or more electrodes 330 from payload CEW 122 toward target 130 (e.g., a first launch). In one embodiment, as electrodes 330 travel toward target 130, wire tethers deploy between a housing of payload CEW 122 and electrodes 330 so that electrodes 330 remain electrically coupled to the housing.

With specific reference to FIG. 3, at some period after the launch of electrodes 330, a housing, such as housing 325 (e.g., the remainder of payload CEW 122) is launched (such as from a bay 321 of launcher 120) (e.g., a second launch). Launching housing 325 may result in housing 325 traveling toward target 130. Meanwhile, electrodes 330 may continue their trajectory toward target 130. Flight of electrodes 330 toward target 130 may occur at a higher velocity than the flight of housing 325, so the wire-tethers may continue to be deployed between housing 325 and electrodes 330 while housing 325 is launched and flies toward target 130.

With specific reference to FIG. 4, electrodes 330 strike target 130 and electrically couple to target 130. Housing 325 lands (e.g., on the ground) within the length of the wire tethers coupled to target 130 (e.g., via electrodes 330). The wire tethers stretch between housing 325 and each electrode 330 respectively. The circuitry (e.g., power supply, signal generator, processing circuit, etc.) of housing 325 operates to provide a stimulus signal through target 130 via electrodes 330. A stimulus signal includes any type of electrical signal that impedes locomotion of a target, including a pulsed current. The circuitry of housing 325 may provide one or more stimulus signals, as discussed further herein.

After launch of payload CEW 122 (e.g., the first launch of the electrodes and the second launch of the housing), user 140 may move drone 110 to a position where user 140 may observe target 130. User 140 may also move drone toward a second target to launch a second payload CEW to impede locomotion of the second target.

As previously discussed herein, the launch of the housing of a payload CEW from a launcher follows (e.g., simultaneously or after) the launch of the electrodes from the payload CEW. A first force may launch the electrodes (e.g., a first launch). A second force may launch the housing (e.g., a second launch). The first force may be released (e.g., activated, fired) at a first time and the second force may be released at a second time following the first time. For example, a first pyrotechnic may be ignited to launch one or more electrodes. Following ignition of the first pyrotechnic, a second pyrotechnic may be ignited to launch the housing. A delay between the launch of the electrodes and the launch of the housing may be short (e.g., microseconds, milliseconds).

A same source of a force may be used to launch both the electrodes and the housing in a manner that movement of the electrodes away from the launcher precedes movement of the housing away from the launcher (e.g., the same source of the force initiates the first launch and the second launch). For example, a pyrotechnic may be ignited to launch the electrodes from the housing toward the target. The rapidly expanding gas from the pyrotechnic is directed toward both the electrodes and the housing; however, the distance from the pyrotechnic to the electrodes is less than the distance from the pyrotechnic to the housing. So, as the force from the gas begins pushing out the electrodes from the payload CEW, it also travels toward the point (e.g., location) where it will operate to push out the housing from the launcher. While the electrodes are in the process of taking flight or have taken flight, a portion of the expanding gas reaches the location where the force from the gas starts pushing the housing out of the launcher. The electrodes may be fully launched before the portion of the expanding gas pushes the housing from the launcher.

In various embodiments, a single input mechanism may be used to launch both the electrodes and the housing (e.g., the single input mechanism initiates both the first launch and the second launch). The single input mechanism may result in at least two different discrete outputs. A first discrete output may result in initiating the first launch of the electrodes. The second discrete output result in initiating the second launch of the housing. In various embodiments, the single input mechanism may comprise a remote control operated by a user. In response to the user operating the remote control, the first discrete output may result in initiating the first launch and the second discrete output may result in initiating the second launch. The second launch may occur simultaneously with or after the first launch.

A payload CEW may be inserted into a bay of a payload launcher. Launch of the housing of the payload CEW leaves the bay empty and ready to receive another payload CEW (e.g., as depicted in FIGS. 3 and 4). A launcher may hold one or more payload CEWs. Payload CEWs may be independently launched from a launcher. A new payload CEW may be inserted into a launcher to replace a launched payload CEW at any time. A drone may return to the user of the drone or fly to another location to be outfitted with new payload CEWs.

In various embodiments, use of a payload launcher capable of housing a plurality of payload CEWs may enable the vehicle to deploy a second payload CEW in response to a first payload CEW missing a target or being unable to incapacitate a target. Use of a payload launcher capable of housing a plurality of payload CEWs may also enable the vehicle to incapacitate a first target and move, target, and/or incapacitate a second target without needing to reload the payload launcher.

In various embodiments, a user (e.g., user 140), while at a distance from a payload CEW, may control (e.g., remotely) the operation of the payload CEW. A user may deploy (e.g., staged launch) a payload CEW. A user may reactivate a payload CEW to provide additional stimulus signals through a target. A user may disable (e.g., stop the operation of) the payload CEW. A user may remotely control one or more payload CEWs.

A user may use equipment (e.g., radio, electronic device, computing device, smart phone, etc.) to directly communicate with one or more payload CEWs. Direct communication with a payload CEW includes wireless communication. An example of direct communication between a user and a payload CEW includes a device with a user interface (e.g., computing device, smart phone, tablet, vehicle controller, etc.) operated by the user to send messages (e.g., signals, data, commands, information, etc.) from the device to one or more payload CEWs. For example, each payload CEW may include an identifier (e.g., address, frequency, code, etc.) for identifying messages for a specific payload CEW. Messages may be sent from the device to one, two or more, or all (e.g., broadcast) payload CEWs at the same time, or in near same time. Any wireless protocol may be used to implement direct communication between a user device and a payload CEW. In various embodiments, encryption may be used to protect communication between a user device and a payload CEW.

A user may use equipment to indirectly communicate with one or more payload CEWs. Indirect communication includes wireless communication. An example of indirect communication between a user and a payload CEW includes a device with a user interface operated by the user to send messages from the device to a drone. The drone may then send (e.g., relay, transmit) the message to the payload CEW. The payload CEW may send information to the user via the drone and the device with the user interface. In a situation where two or more drones operate, messages to a payload CEW may be forwarded from one drone to another before reaching a payload CEW. Forwarding from one drone to another drone may also occur while sending messages from a payload CEW to a user device.

In various embodiments, a payload CEW may include all mechanical, electrical, and/or electronic devices needed to deliver a stimulus signal to a target. For example, a payload CEW includes a housing. The housing houses (e.g., holds, contains) all of the components of a payload CEW. Components of a payload CEW include electrodes, one or more pyrotechnics for sequentially launching the wire-tethered electrodes and/or the housing, a power supply (e.g., battery), electronics (e.g., processing circuit, memory, etc.), and a signal generator. A payload CEW may further include a communications circuit for communicating (e.g., sending, receiving) electronic messages (e.g., communications, communication signals, etc.). A communications circuit may transmit and send electronic messages wirelessly. For example, the communications circuit may enable the payload CEW to receive instructions (e.g., from the vehicle, the launcher, etc.) to provide a second stimulus signal through a target, after the housing has been deployed from the launcher.

An electrode couples to a target to provide a stimulus signal through a target to impede locomotion of a target. An electrode includes a body and one or more spears. A body may provide weight to improve the flight characteristics of the electrode. A body may provide drag to improve the flight characteristics of an electrode. A body may house (e.g., stow, store) a wire tether. A wire tether may deploy from a body during flight of the electrode. A first end portion of a wire tether may mechanically and electrically couple to a body of the electrode. A second end portion of a wire tether may mechanically and electrically couple to a signal generator.

A body of an electrode may be cylindrical in shape. A body of an electrode may be positioned in a bore in the housing prior to launch. A body of an electrode may move along the bore to exit the housing at launch. A bore may establish an initial flight trajectory of an electrode.

A spear may aid in mechanical and electrical coupling of an electrode to a target. A spear may include a pointed (e.g., narrowed, sharpened) end portion to aid in piercing target clothing and/or target tissue. A spear may be wholly or partially electrically conductive to establish an electrical connection with a target. A spear may include one or more mechanical structures (e.g., barbs) for retaining mechanical and electrical coupling of the spear to the target.

A pyrotechnic includes any type of device or substance that may be controlled to provide a rapidly expanding gas. A pyrotechnic may include gun powder, a primer, a canister of compressed gas, or the like. Control of a pyrotechnic to provide the rapidly expanding gas may include igniting, electrically or by percussion (e.g., striking), the pyrotechnic so that it burns to provide the rapidly expanding gas. Control of a pyrotechnic may include piercing a canister to release a compressed gas as a rapidly expanding gas.

As discussed above, separate pyrotechnics may be used to launch electrodes and the housing or the same pyrotechnic may be used to launch both in a serial manner. The one or more pyrotechnics launch the electrodes first, followed by launch of the housing.

A power supply may include any type of power supply. For example, a power supply may include a battery. A battery may be maintained in an inactive state during storage of a payload CEW and activated just prior to deployment of the payload CEW. A power supply may include a capacitance that is charged, (e.g., by the launcher) just prior to deployment of the payload CEW. A power supply provides energy for operation of the payload CEW and immobilization of the target. A power supply may provide energy in the form of electricity. A power supply may provide energy for operation of the electronics and signal generator of the payload CEW.

The electronics of a payload CEW may control the operation of the payload CEW. The electronics of a payload CEW may include a processing circuit (e.g., microprocessor, microcontroller, processor, etc.) and a memory. The electronics of a payload CEW may further include a communications circuit. A processing circuit may control some or all of the operations (e.g., functions) of a payload CEW. A processing circuit may control launch of electrodes and/or launch of the housing. A processing circuit may control the signal generator, in whole or in part, to provide one or more stimulus signals. A processing circuit may control providing pre-programmed messages to a target. A processing circuit may receive signals from sensors (e.g., motion sensors) to determine whether another stimulus signal should be provided to a target.

A signal generator may generate a stimulus signal. A signal generator may receive energy from a power supply. A signal generator may transform the energy from a power supply to form the stimulus signal. For example, a signal generator may increase a voltage of the electrical power provided by a power supply (e.g., 1.5-9 volts) to be about 1,500 volts (e.g., 1,600 volts peak). A signal generator may provide pulses of current at a voltage of about 1,500 volts. A signal generator may provide a series of pulses of current as a stimulus signal. A pulse of current may have a pulse width. A series of pulses of current may have a pulse repetition rate. A stimulus signal may include a fixed number of current pulses provide over a period of time. A stimulus signal may include a variable number of current pulses over a period of time.

A signal generator, as discussed above, may couple (e.g., directly, indirectly) to two or more wire tethers. A signal generator may couple to a wire tether via one or more spark gaps, a transformer, a silicon control rectifier (e.g., thyristor), and/or the like. The two or more wire tethers may couple to respective electrodes. A signal generator may provide a stimulus signal through target tissue via two or more electrodes and their respective wire tethers. A wire tether may also be referred to simply as a wire or a filament.

A payload CEW may be disposable or at least partially reusable. For example, and with reference to FIG. 5, a payload CEW 500 may be disposable. Prior to launch, all components of payload CEW 500 are housed in housing 510. Housing 510 may be unitary (e.g., one-piece, monolithic, etc.) or formed of several pieces that are coupled together. Housing 510 is shown as having portions that contain a housing launch portion 520, an electronics portion 530, and an electrodes portion 540. At launch, two or more electrodes are launched from bores 550 (e.g., one electrode per bore) followed by the launch of housing 510, as previously discussed. After payload CEW 500 is used to provide a stimulus signal through a target, housing 510, the launched electrodes, and the wire tethers are all disposed of Although depicted in FIG. 5 as comprising three pieces coupled together, it should be understood by one skilled in the art that payload CEW 500 may comprise any suitable or desired number of pieces (e.g., two pieces, four pieces, etc.).

Figure 6:
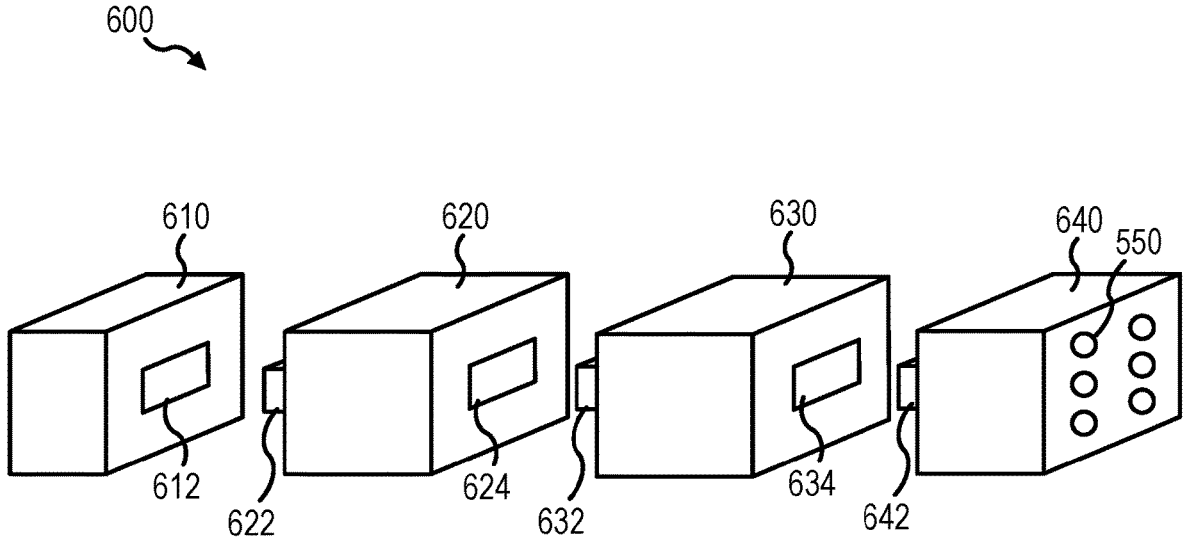

In various embodiments, and with reference to FIG. 6, a payload CEW 600 is disclosed. Payload CEW 600 may include one or more portions such as a housing launch portion 610, a power supply portion 620, an electronics portion 630, and/or a cartridge portion 640. Each portion may comprise an interface configured to enable the portion to communicate with (e.g., electrically, electronically, etc.) or couple to (e.g., electrically, mechanically, etc.) a second portion. For example, housing launch portion 610 may comprise an interface 612 (e.g., housing launch interface, housing launch female interface, etc.); power supply portion 620 may comprise an interface 622 (e.g., first power supply interface, power supply male interface, etc.) and/or an interface 624 (e.g., second power supply interface, power supply female interface, etc.); electronics portion 630 may comprise an interface 632 (e.g., first electronics interface, electronics male interface, etc.) and/or an interface 634 (e.g., second electronics interface, electronics female interface, etc.); and/or cartridge portion 640 may comprise an interface 642 (e.g., cartridge interface, cartridge male interface, etc.).

Interface 612 of housing launch portion 610 may be configured to interface with interface 622 of power supply portion 620 to couple housing launch portion 610 to power supply portion 620. Interface 624 of power supply portion 620 may be configured to interface with interface 632 of electronics portion 630 to couple power supply portion 620 to electronics portion 630. Interface 634 of electronics portion 630 may be configured to interface with interface 642 of cartridge portion 640 to couple electronics portion 630 to cartridge portion 640.

Payload CEW 600 may be reusable (e.g., reloadable). Portions of payload CEW 600 that cannot be reused may include cartridge 640 and/or housing launch 610. It may be practically difficult to reuse cartridge 640 because preparing the electrodes, and in particular the wire tethers, for a second use is time consuming. Preparing the spears of the electrodes for a second use may require sterilization. Further, burning of the pyrotechnic to launch the electrodes may cause damage to cartridge 640 that is expensive, time-consuming, or impractical to repair.

Housing launch 610 may also include a pyrotechnic that is burned to launch payload CEW 600 from a launcher. Damage done by burning of the pyrotechnic may be expensive, time-consuming, or impractical to repair.

However, all portions (e.g., units) (e.g., 610, 620, 630, 640) of payload CEW 600 may include one or more interfaces so that some portions may be replaced, and other portions reused. For example, in one embodiment, power supply 620 may be recharged, coupled to a new housing launch 610 via interface 612 and 622. Recharged power supply 620 may be coupled to electronics 630 via interface 624 and 632. Electronics 630 may include all electronics and the signal generator for providing the stimulus signal. Electronics 630 may be removed from a used (e.g., deployed) payload CEW and coupled to a new or recharged power supply 620. A new cartridge 640 may be coupled to electronics 630 via interface 634 and 642.

A rebuilt payload CEW 600 may be inserted into a bay of a launcher for launch. Power supply 620 may be retrieved and recharged for further use until irreparably damaged. Electronics 630 may be retrieved and reused until irreparably damaged. Although depicted in FIG. 6 as comprising four portions, it should be understood by one skilled in the art that payload CEW 600 may comprise any suitable or desired number of portions (e.g., three portions, five portions, etc.).

Figure 7:
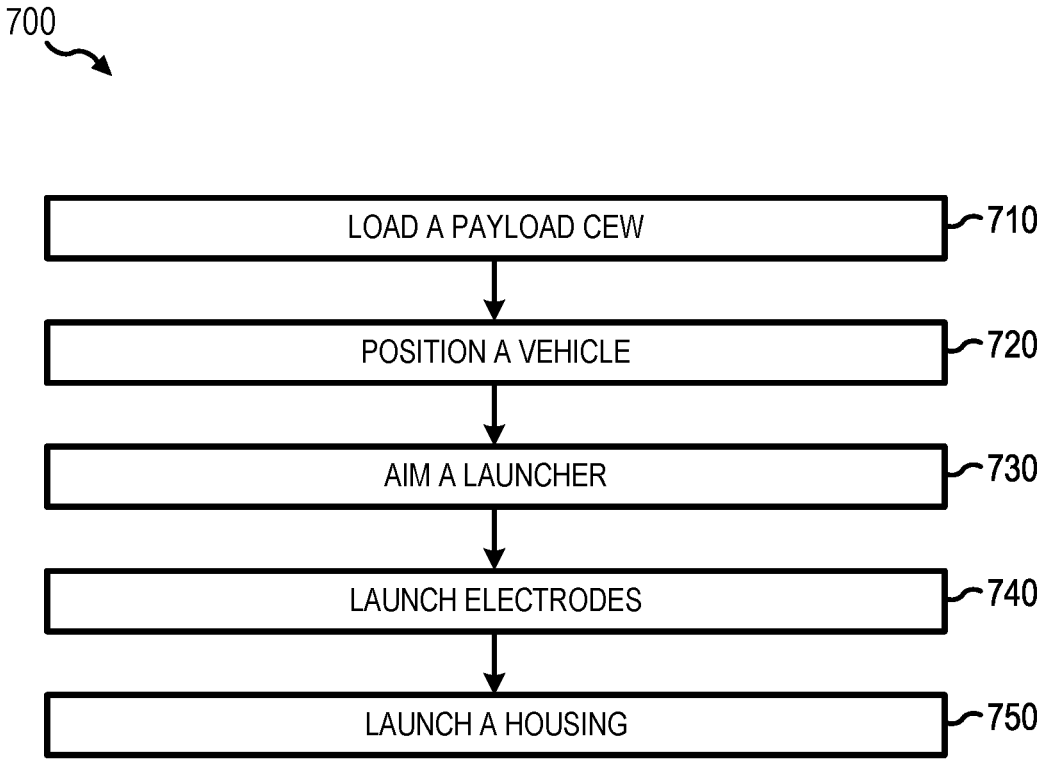
FIG. 7 is a block diagram illustrating a method for deployed a payload CEW, in accordance with various embodiments.

In various embodiments, and with reference to FIG. 7, a flowchart 700 for deploying a payload CEW is disclosed. Flowchart 700 depicts one combination of blocks that may be implemented in accordance with one embodiment. Those of ordinary skill in the art will realize that flowchart 700 and/or any other implementations herein may utilize additional and/or fewer blocks, components, and/or systems (including those discussed with respect to other figures and/or known in the art). Further, absent expressly indicating otherwise, the ordering of describing various implementations and blocks is merely for illustrative purposes and not intended to limit the scope of this disclosure. As understood by a person of ordinary skill in the art, a computer-readable medium comprising computer-executable instructions that are configured to be executed by a processor to perform one or more processes included within one or more blocks within this and/or any other flowchart or embodiment disclosed herein. Deploying a payload CEW may include loading the payload CEW (e.g. block 710), positioning a vehicle (e.g., block 720), aiming a launcher (e.g., block 730), launching electrodes (e.g., block 740), and launching a housing (e.g., block 750).

In various embodiments, loading a payload CEW (e.g., such as at block 710) includes coupling a payload CEW to a launcher of a vehicle. In one such embodiment loading may include inserting a payload CEW into a bay of a launcher. As discussed herein, a launcher may include one or more bays. Each bay may receive one payload CEW. The launcher may be mounted on a vehicle or may be configured to be mounted on a vehicle. A vehicle includes any type of device that may travel under a power source. A vehicle may move under at least partial operation of a user (either remotely or locally). A vehicle may also be operable solely by a computing device, such as, for example, through the use of artificial intelligence. A vehicle may include a remotely controlled autonomous vehicle. For example, a vehicle may comprise an unmanned aerial vehicle (UAV) (e.g., a drone), an unmanned ground vehicle (UGV), an unmanned surface vessel (USV) (e.g., unmanned surface vehicle, autonomous surface vehicle, etc.), a robot, a helicopter, a car, or the like (e.g., "vehicle types"). A ground vehicle may comprise one or more wheels, continuous track (e.g., tank tread, caterpillar track, etc.), or the like configured to enable movement of the vehicle on land. Remote control includes control of, at least whole or in part, the vehicle with any distance between the user (or computing device) who controls and the vehicle. A launcher may be manually loaded by a user or other technician. Loading a launcher may include any type of semi-automated loading while stationary or while in motion.

In one implementation, the vehicle may be positioned or moved into range with a target (e.g., block 720). Movement of the vehicle may be manual and/or automatic after identification of a target. Movement of the vehicle may be controlled by a user via a remote control device. Movement of the vehicle may include identification and/or tracking of a target. As previously discussed, bringing a payload CEW into range with a target may include bringing the payload CEW to within a distance that is about the same or less than the length of the wire tethers that tether the electrodes to the housing of the payload CEW.

In various embodiments, the launcher may be oriented or aimed at the target (e.g. block 730). For example, upon or after the payload CEW being within the range of a target, the launcher may be oriented or positioned so that one or more of the payload CEWs points toward the target, and so that two or more of the electrodes from a payload CEW will strike the target when launched. A threshold probability may be required for the launcher to be deemed properly oriented or positioned. In various embodiments, the threshold probability is at least 50%, 60%, 70%, 80%, or 90%. Those skilled in the art will appreciate that these are merely examples and higher and/or lower thresholds may be utilized depending on the specific intention and/or use. Further, sensor and/or human-provided data may be used to determine the determined probability and/or the threshold probability. In one embodiment, wind speed may be utilized in the determination. Other factors include but are not limited to temperature, the launching power of the launcher, the vehicle speed, altitude, fuel level, speed and/or distance of the target, and/or combinations thereof or other factors. In one embodiment, a launcher may be positioned (e.g., block 720) by positioning the vehicle to which the launcher is coupled. For example, a drone may move in any direction (e.g., up, down, left, right) to point the launcher in a direction. A launcher or vehicle may include mechanical adjusters (e.g., pistons, gimbal) to move the launcher relative to the vehicle to aim the launcher toward the target (e.g., block 720 and/or 730). In one embodiment, a computer-readable medium may comprise computer-executable instructions that when executed by a processor, cause the processor to perform at least: selecting a plurality of locations for a desired effect. In one embodiment, the selections may be selected based upon meeting a probability threshold of causing NMI and/or having the highest probability of inducing NMI. In another embodiment, it may be based on thermal energy suggesting that the user is not wearing armor or otherwise covered with impenetrable material in one or more locations. Those skilled in the art will appreciate that one or more selection criteria may be utilized, and these are mere examples. In certain embodiments, a plurality of trajectories may be calculated. In certain embodiments, one or more trajectories may be simultaneously determined. Trajectories may include but are not limited to: the speed, direction, and/or acceleration of the vehicle itself. In yet another embodiment, the speed, direction, and/or acceleration of projectiles, such as darts that it fires in rapid succession (e.g. over a few milliseconds in one embodiment) may be determined. In yet other embodiments, one or more environmental factors may be determined and/or utilized. For example, wind speed and/or direction may be utilized in one or more calculations and/or determinations.

In one embodiment, a user may control all or part of the operations required to aim a launcher toward a target, such as at block 730. Aiming may be accomplished automatically using object recognition in which an image of the target is analyzed to determine where the electrodes might land on the target after launch. During manual or automatic aiming (e.g., targeting), if the electrodes are not predicted to land at a desired location on the target, the position and/or orientation of the vehicle and/or the launcher may be changed to modify a predicted location of impact of the electrodes with the target. Predicting a location of impact and moving to improve the predicted location of impact may be repeated until a suitable location of impact is identified for each electrode and/or until a threshold probability of contact with one or more electrodes is achieved.

In an implementation, aiming individual electrodes identifies a location of predicted impact of one electrode. In various embodiments, one or more electrodes are launched (e.g., block 740) In one embodiment, two or more electrodes are launched to provide a stimulus signal through the target. If electrodes are launched one at a time, two or more electrodes may be launched serially (e.g., one-after-another, sequentially) toward the target so that two or more electrodes electrically couple to the target to provide the stimulus signal through the target. In an implementation of serial launching of individual electrodes, aiming (e.g., block 730) may identify a first location of predicted impact then launch (e.g., block 740) launches a first electrode. As part of positioning, aiming, and/or launching (e.g., blocks 720, 730, 740) the vehicle or the aiming mechanism may be moved (or instructed to move) an amount in a direction to a second location of impact. A second electrode may be launched as soon as a second location is identified. In one embodiment, aiming block 730 may identify additional locations and launch block 740 may launch additional electrodes.

In various embodiments, following the launching of at least one electrode from the housing while still coupled to the vehicle, a housing from which the electrode was launched may be launched or jettisoned (e.g., block 750). In one implementation, once the last electrode has been launched, the housing may be launched or otherwise uncoupled from the vehicle. In one illustrative example, the time between launch of two serially launched electrodes may be in the range of 1 millisecond to 2 seconds.

Serially aiming and launching electrodes may include identifying a location on a living target and moving to a next location to strike a specific location on the living target in a pattern. For example, aiming (e.g., block 730) may identify a chest of a target. After launch (e.g., such as at block 740) has launched an electrode toward the chest, aiming (which may in certain embodiments reactivate block 730 and/or another implementation) may be utilized to control movement of the vehicle and/or the aiming mechanics to move the payload CEW down and to the right to launch an electrode toward the left leg (e.g., target facing the launcher) of the target. After launch (which may reactivate block 740 and/or invoke a different mechanism) has launched an electrode toward the left leg, aiming (e.g., block 730 or other mechanism) may control movement of the vehicle and/or the aiming mechanics to move the payload CEW to the left to launch an electrode toward the right leg of the target. After launch 740 has launched an electrode toward the right leg, aiming (e.g., block 730 or other implementations) may control movement of the vehicle and/or the aiming mechanics to move the payload CEW up and to the right to launch an electrode toward the stomach of the user. Those skilled in the art will appreciate that the above-referenced locations are merely exemplary and other locations and/or quantity of locations may be utilized without departing from the scope of this disclosure.

Movement of a vehicle and/or aiming mechanics may be fully automated and occur in an automated manner without human intervention in certain embodiments. Any pattern may be used to aim and launch electrodes at any part of the target. A pattern of aiming and launching may include aiming and launching electrodes toward a front of a target then moving behind the target to aim and launch electrodes toward the rear of a target. Further, a selection of certain electrodes may be implemented. For example, longer electrodes (e.g., configured to penetrate the target deeper) may be utilized depending on the target (e.g., height, weight), type of target, covering or clothing material over a portion of the target, combinations thereof, and/or other factors.

In one embodiment, a pattern used to aim and serially launch electrodes may depend on the first body part identified (for example, by aiming 730). A pattern may depend on the type or size (e.g., height, weight, etc.), covering or clothing material over a portion of the target, combinations thereof, and/or other factors.

Launch 750 may launch the housing from the launcher. If two or more electrodes are launched at the same time, launch 750 launches the housing of the payload CEW a period of time after the launch of the two or more electrodes. After launch 750 has launched the payload CEW, the bay of the launcher that held the now launched payload CEW is empty and ready to receive a new or refurbished payload CEW as discussed above.

In various embodiments, a payload CEW may include a visual indicator (e.g., visual identifier, visual signal, etc.). A visual indicator may visually provide information as to an identity of a payload CEW. A visual indicator may enable a user to distinguish between two or more launched payload CEWs. A visual indicator may correspond to controls (e.g., buttons, portions of touch screen, icons on touch screen, etc.) on a remote control. A user may use the visual indicators to control (e.g., reactivate) a payload CEW. A user may observe the visual indicators on deployed payload CEWs, identify the control on a remote control that corresponds to a visual indicator on a particular payload CEW, and operate the control to reactivate the particular payload CEW that corresponds the visual indicator.

A visual indicator may include a light (e.g., LED) that provides a color of light. A visual indicator may include a light that flashes a pattern (e.g., long flash, short flash). A flash pattern may be analogous to the dot (e.g., short flash) and the dash (e.g., long flash) signals used in Morse code. Light provided by a visual indicator may be in any frequency range and may require a user to use eye gear to detect the light. A visual indicator simply be the color of the housing of the payload CEW. In various embodiments, the color of the housing as a visual indicator may be a high-visibility color.

Figure 8:
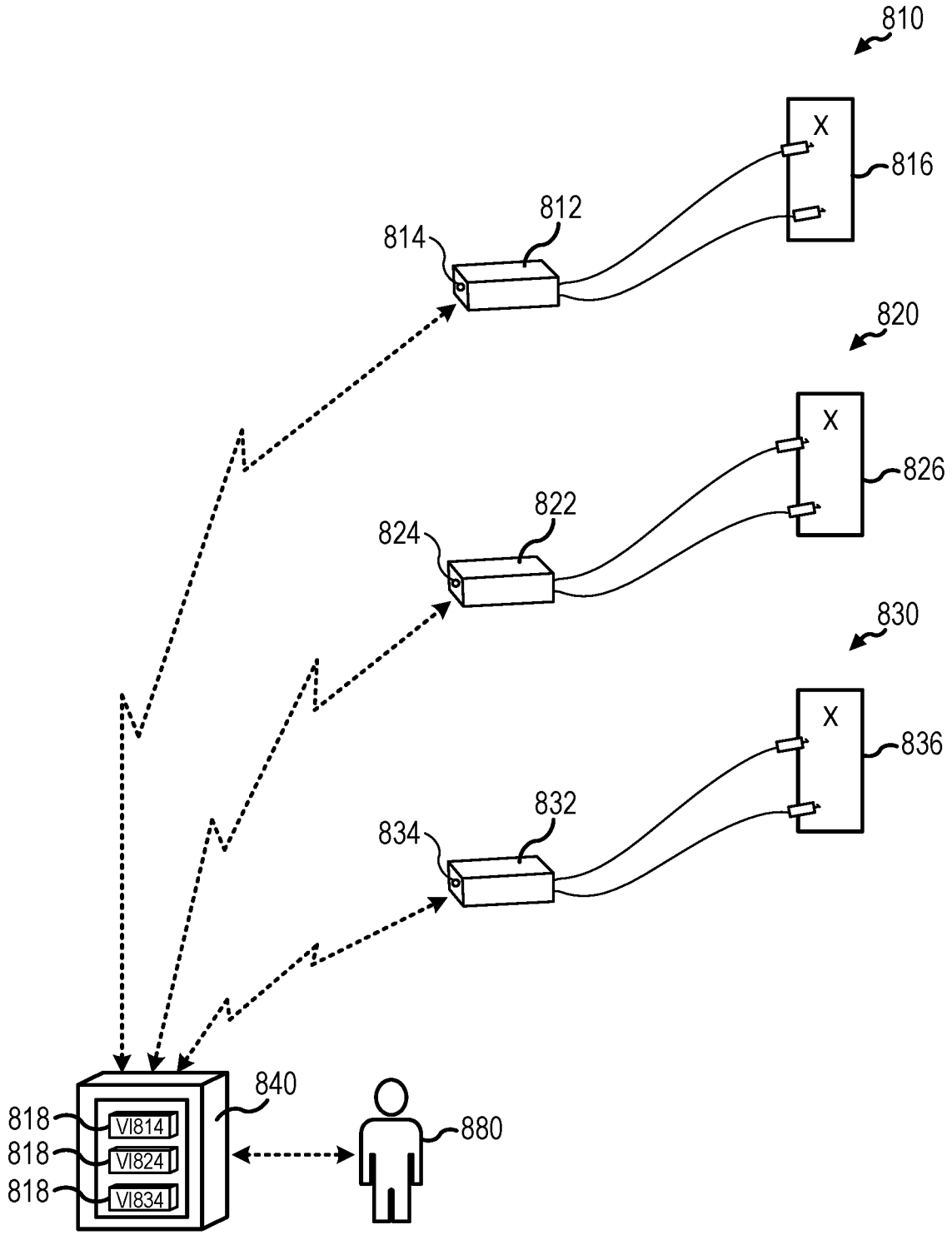
FIG. 8 illustrates an exemplary payload CEW having a visual indicator, in accordance with various embodiments.

For example, in accordance with various embodiments and with reference to FIG. 8, three payload CEWs, payload CEW 810, payload CEW 820, and payload CEW 830, have been deployed. Each payload CEW 810, 820, and 830 provides a stimulus signal to targets 816, 826, and 836 respectively via wire-tethered electrodes. Housing 812, 822, and 832 of payload CEW 810, 820, and 830 include visual indicator 814, 824, and 834 respectively. Visual indicator 814, 824, and 834 are visible to user 880. Each visual indicator 814, 824, and 834 provides a visual signal (e.g., color of light, color of housing, flash pattern, etc.) that is distinct from the visual signal of the other visual indicators. For example, visual indicators 814, 824, and 834 may each provide a light having a different color respectively. In another example, visual indicators 814, 824, and 834 may each flash different patterns of long and short flashes of light. User 880 may visually distinguish between the visual indicators 814, 824, and 834.

A remote control 840 includes controls 818, 828, and 838. Control 818, 828, and 838 correspond to visual indicator 814, 824, and 834 respectively. Control 818, 828, and 838 may include a source of light that mimics the visual indicator provided by visual indicator 814, 824, and 834 respectively. User 880 may view the visual indicators provided by payload CEWs 810, 820, and 830. User 880 may observe target 816, 826, and 836 associated with payload CEW 810, 820, and 830 respectively. User may determine that one or more targets 816, 826, and 836 could use an additional stimulus signal. To provide an additional stimulus signal to a target, user 880 observes the target, determines whether the target needs an additional stimulus signal, identifies the visual identifier of the payload CEW coupled to the target that needs the additional stimulus signal, identifies the control on remote control 840 that corresponds to the visual indicator of the payload CEW that needs to provide the additional stimulus signal, and selects (e.g., operates, activates, etc.) the control associated with the visual indicator to provide the additional stimulus signal to the identified target.

In an implementation, visual indicator 814, 824, and 834 of payload CEW 810, 820, and 830 is a flashing blue light, a flashing green light, and a flashing red light respectively. Control 818, 828, and 838 on remote control 840 is a lighted switch that glows blue, green, and red respectively. User 880 monitors targets 816, 826, and 836. User 880 determines that target 826 should receive an additional stimulus signal. Any criteria, including movement, may be used by user 880 to determine whether a target should receive an additional stimulus signal. User 880 visually identifies that payload CEW 820 is associated with target 826. User 880 detects the green flashing light from payload CEW 820 and that payload CEW 820 is proximate to and likely coupled to target 826. User 880 visually identifies the lighted switch (e.g., 828) that is green in color. User 880 operates control 828, which provides a green light. Activation of control 828 causes remote control 840 to transmit control signal 860. Payload CEW 820 receives control signal 860. In response to receiving control signal 860, payload CEW 820 provides an additional stimulus signal to target 826.

In the event that user 880 determines that target 816 needs an additional stimulus signal, user 880 visually detects the blue flashing light from visual indicator 814 and selects control 818 which emits a blue light. In response to operating control 818, remote control 840 transmits control signal 850. Payload CEW 810 receives control signal 850. In response to control signal 850, payload CEW 810 provides an additional stimulus signal to target 816.

In the event that user 880 determines that target 836 needs an additional stimulus signal, user 880 visually detects the red flashing light from visual indicator 834 and selects control 838 which emits a red light. In response to operating control 838, remote control 840 transmits control signal 870. Payload CEW 830 receives control signal 870. In response to control signal 870, payload CEW 830 provides an additional stimulus signal to target 836.

In a launcher that launches two or more payload CEWs, the visual signal (e.g., color, flash pattern) provided by the payload CEWs may be assigned prior to launch of the payload CEW. The launcher may also provide information as to the visual signal assigned to each payload CEW, so that the remote control used to control the deployed payload CEWs may assign corresponding visual signals to controls on the remote control to associate a control to a payload CEW. For example, a launcher that carries two payload CEWs, may assign the visual indicator on one payload CEW to provide a blue light and the other visual indictor to provide a red light. The launcher may provide the assigned indicator information to a remote control so that one control on the remote control is associated with a blue light and another control on the remote control is associated with a red light. Assigning the payload CEWs to have an indicator signal and the remote control to have controls associated with those signals allows a user to visually identify the different deployed payload CEWs and visually identify the control that must be operated to provide an additional stimulus signal.

In another example, a launcher that carries two payload CEWs, may assign the visual indicator on one payload CEW to provide a fast flashing light (e.g., dot) and the visual indicator of the other payload CEW to provide an alternating fast then slow (e.g., dot-dash) flashing light. The launcher may provide the indicator signal information to a remote control that assigns the dot indicator signal to one control and the dot-dash indicator signal to another control. The user may visually identify the deployed payload CEWs and operate the corresponding control on the remote control to provide an additional stimulus signal to the corresponding target.

Launchers coupled to many vehicles (e.g., UAVs, UGVs, USVs, etc.) may cooperate so that the payload CEWs launched by the many launchers each have a different visual signal used to identify the corresponding payload CEW. Cooperation between launchers may occur via wireless communication.

A launcher may keep a log (e.g., record) of assigned visual indicator signals so that a number of serially launched payload CEWs each have a different visual indicator signal.

Distance may also be used as a visual indicator. A payload CEW may transmit its geographic coordinate (e.g., GPS coordinate) to a remote control. A remote control may calculate the distance from the remote control to each deployed payload CEW. The remote control may display the distance to each payload CEW proximate to a respective control on the remote control. A user may visually identify the deployed payload CEWs. A user may detect the relative distance from the user to each payload CEW. The user may compare the viewed distance from the user to the payload CEWs to the distances shown on the remote control for each payload CEW. A user may determine that the nearest payload CEW should provide an additional stimulus signal. The user may select the control that has the closest (e.g., smallest distance) number to reactivate the closest payload CEW. A user may compare the relative distance as viewed by the user to the relative distances shown on the remote control to operate the control that corresponds to the payload CEW that should provide the additional stimulus signal.

A remote control for reactivating payload CEWs in accordance with their visual indicator signal may be separate from the control that operates the vehicle used to deploy the payload CEWs or it may be integrated with the vehicle control.

Communication between the remote control and the deployed payload CEWs may be directly from the remote control to the payload CEWs or via the vehicle that delivers the payload CEWs. In various embodiments, communication may also include communication over a network.

In various embodiments, a sight (e.g., aiming device) may be used to aim (e.g., target) a payload CEW. A sight may be used alone, or in combination with a camera of the vehicle that carries the launcher of the payload CEW. A sight may indicate a predicted point of impact of an electrode independent of the orientation of the camera.

Figure 9:
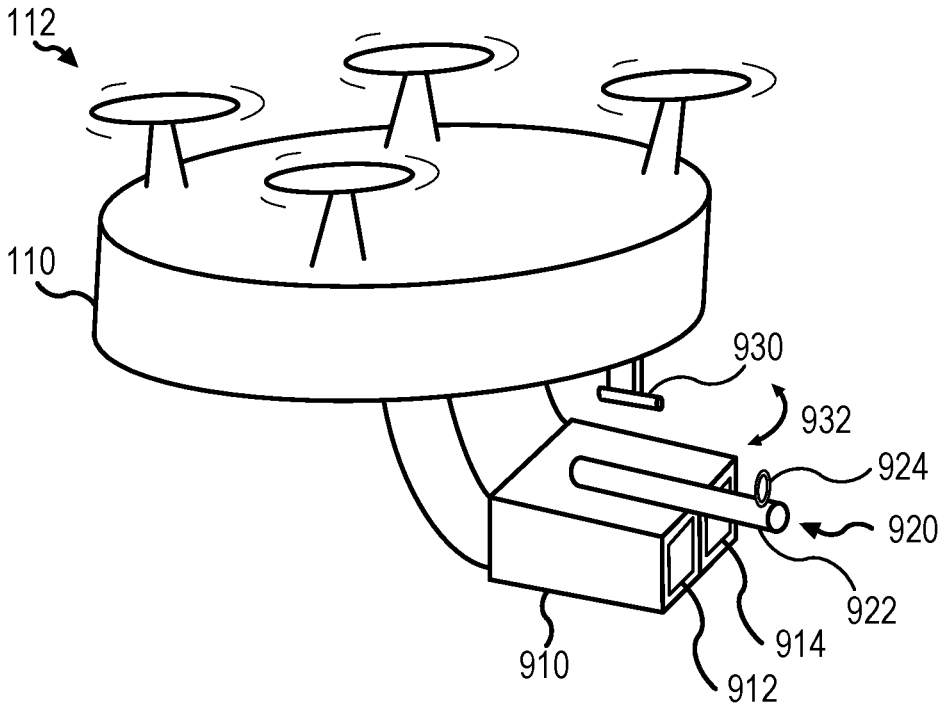
FIG. 9 illustrates a vehicle having a payload CEW and an aiming device, in accordance with various embodiments.

In an implementation, and with reference to FIG. 9, a sight 920 includes a rod 922 and a ring 924. Rod 922 is coupled (e.g., mounted) with respect to a launcher 910 so that ring 924 indicates via a camera 930 the likely point of impact of the electrodes of a payload CEW. In the implementation shown in FIG. 9, rod 922 is mounted to launcher 910; however, rod 922 could be mounting to drone 110 to accomplish the same objective.

Figure 10:
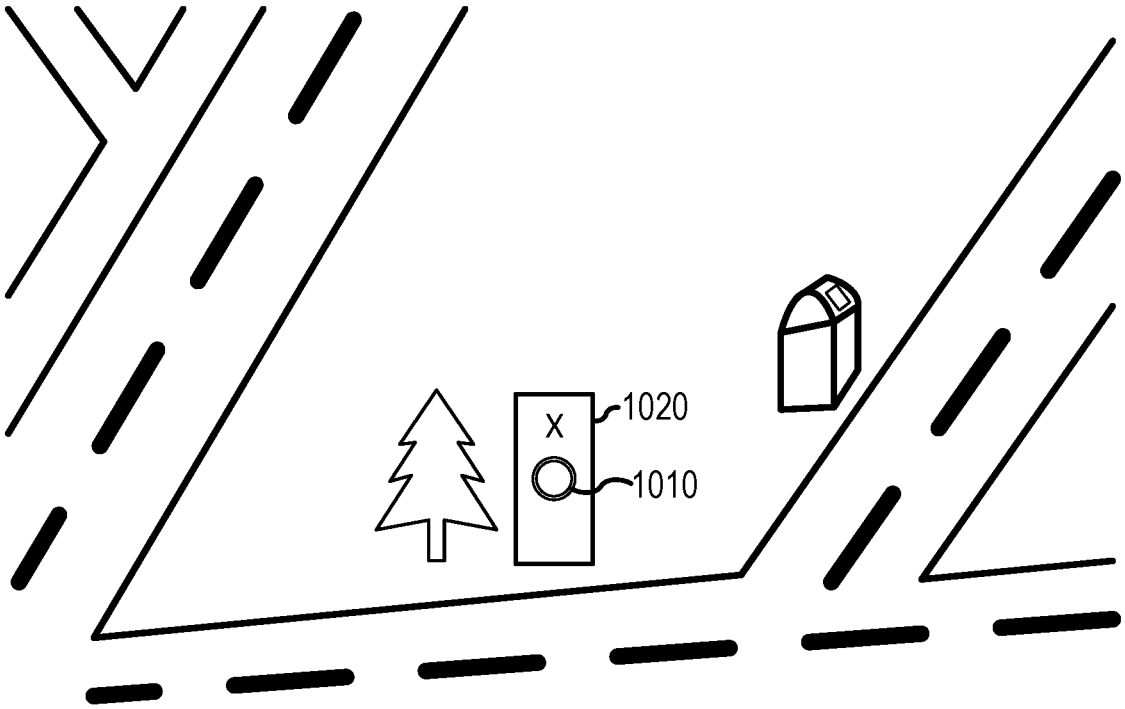
FIGS. 10 and 11 depict example views of an implementation and use of an aiming device for a payload CEW on a vehicle, in accordance with various embodiments.

Launcher 910 includes a bay 912 (e.g., a first bay) and a bay 914 (e.g., a second bay). An implementation could include one sight for each bay. A payload CEW (not shown) may be loaded into bay 912 and/or bay 914. Drone 110 may orient itself and thereby launcher 910 so that camera 930 views ring 924 as overlapping a target. Referring to FIG. 10, an image of ring 1010 as seen via camera 930 overlaps target 1020. The position of the image of ring 1010 over target 1020 predicts that the electrodes from a payload CEW launched from launcher 910 will strike the target.

Figure 11:
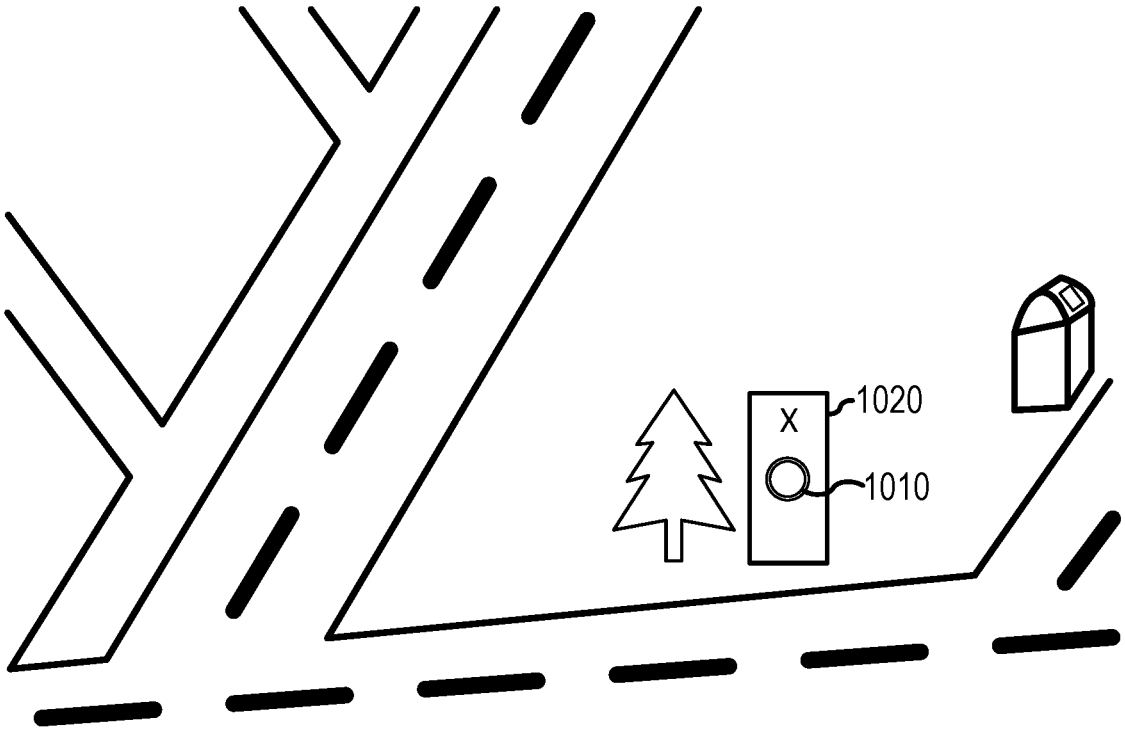

Even as camera 930 pans in direction 932, the image of ring 1010 remains over target 1020. Referring to FIG. 11, and in accordance with various embodiments, camera 930 has panned left so that more information may be viewed to the left of the image depicted in FIG. 10, yet the view through ring 924 still shows the image of ring 1010 over target 1020. So, sight 920 enables a user of drone 110 to pan camera 930 left and right without losing the ability to aim launcher 910.

Further exemplary embodiments are described below.

A payload conducted electrical weapon ("CEW") may comprise a housing configured to be removably inserted into a bay of a launcher positioned on a vehicle, the housing including: a processor; a signal generator configured to generate a stimulus signal; a plurality of wire-tethered electrodes; and a non-transitory computer-readable medium. The non-transitory computer-readable medium may comprise computer-executable instructions that when executed by a processor, perform at least: initiate a first launch configured to launch at least two of the plurality of the wire-tethered electrodes from the housing toward the target, instruct the signal generator to provide a first stimulus signal through the target via at least a portion of the at least two wire-tethered launched electrodes to impede locomotion of the target; and instruct the initiation of a second launch configured to launch the housing, including the processor and the signal generator, from the bay of the launcher, whereby the housing lands on a surface within the range of the target, wherein the at least two wire-tethered electrodes remain coupled to the signal generator before, during and after the first launch and the second launch.

The payload CEW of any of the above embodiments, wherein the non-transitory computer-readable medium comprises instructions that when executed by the processor, perform at least: receive a determination that the vehicle is within a range of a human or animal target prior to initiating the first launch. The payload CEW of any of the above embodiments, further comprising a power supply, wherein: the power supply is positioned in the housing and configured to provide energy to the signal generator to the signal generator for generating the first stimulus signal. The payload CEW of any of the above embodiments, wherein the power supply is further configured to provide energy to the signal generator for generating a second stimulus signal for delivery through the target to impede locomotion of the target. The payload CEW of any of the above embodiments, further comprising a first pyrotechnic and a second pyrotechnic, and wherein the non-transitory computer-readable medium comprises instructions that when executed by the processor, perform at least instructing the first launch is configured to ignite the first pyrotechnic to initiate the first launch; and instructing the second launch ignites the second pyrotechnic to initiate the second launch.

The payload CEW of any of the above embodiments, wherein the housing is a first housing, and the payload CEW is configured to receive a second housing after the first housing is launched from the bay of the launcher. The payload CEW of any of the above embodiments, wherein the bay of the launcher comprises a first bay, wherein the launcher comprises a second bay, and wherein the second bay is configured to receive a second housing. The payload CEW of any of the above embodiments, wherein the range is a distance less than a length of a wire-tether of one of the at least two wire-tethered electrodes. The payload CEW of any of the above embodiments, further comprising a visual indicator, wherein the visual indicator is configured to identify the payload CEW for providing a second stimulus signal. The payload CEW of any of the above embodiments, further comprising a visual indicator configured to identify the payload CEW that is detectable by a remote user for determining whether to reactivate the payload CEW to provide a second stimulus signal via a remote electric signal.

The payload CEW of any of the above embodiments, wherein the launcher is removably mounted on the vehicle. The payload CEW of the above embodiment, wherein the launcher is removably mounted on the vehicle using a rail interface system. The payload CEW of the above embodiments, wherein the rail interface system comprises a Weaver rail system. The payload CEW of the above embodiments, wherein the rail interface system comprises a Picatinny rail system. The payload CEW of the above embodiments, wherein the launcher is movably mounted between at least two of the vehicle, a second vehicle, and a weapon. The payload CEW of the above embodiments, wherein the vehicle comprises a different vehicle type than the second vehicle. The payload CEW of the above embodiments, wherein the weapon comprises a firearm.

The payload CEW of any of the above embodiments, wherein the initiation of the first launch is conducted after initiating the first launch. The payload CEW of any of the above embodiments, wherein the second launch is initiated within 0.5 seconds of the first launch. The payload CEW of any of the above embodiments, wherein the initiation of the first launch and the second launch occur simultaneously. The payload CEW of any of the above embodiments, wherein the initiation of the first launch and the second launch are initiated by a single input mechanism. The payload CEW of the above embodiment, wherein the single input mechanism results in two different discrete outputs, wherein a first discrete output results in initiating the first launch and a second discrete output results in initiating the second launch.

The payload CEW of any of the above embodiments, wherein the vehicle comprises an autonomous vehicle. The payload CEW of any of the above embodiments, wherein the vehicle comprises an unmanned aerial vehicle (UAV). The payload CEW of any of the above embodiments, wherein the vehicle comprises an unmanned ground vehicle (UGV). The payload CEW of the above embodiment, wherein the UGV comprises at least one of a wheel and a continuous track. The payload CEW of the above embodiment, wherein the UGV comprises a tank. The payload CEW of any of the above embodiments, wherein the vehicle comprises an unmanned surface vessel (USV).

The payload CEW of any of the above embodiments, wherein the launcher comprises at least one of a camera, a guidance system, a global positioning system, an object detection system, a communications system, a speaker, and a microphone. The payload CEW of any of the above embodiments, wherein the housing further includes a communications circuit in communication with the processor. The payload CEW of the above embodiment, wherein the communications circuit is configured to receive a communication signal from at least one of the vehicle or a remote control of the vehicle, and wherein the communications circuit is configured to receive the communication signal before, during, and after the first launch and the second launch. The payload CEW of the above embodiment, wherein the communication signal is received after the second launch, and wherein the communication signal comprises an instruction to provide a second stimulus signal through the target.

A method for providing a stimulus signal through tissue of a human or animal target to impede locomotion of the target, the method comprising: providing a payload CEW having a housing attached to a vehicle within a range of the target; electronically initiating a first launch of two or more wire-tethered electrodes from the housing of the payload CEW toward the target, the two or more wire-tethered electrodes configured to be coupled to the target; and after initiating the first launch of the two or more wire-tethered electrodes, initiating a second launch of the housing of the payload CEW toward the target, all components of the payload CEW positioned within the housing except for the two or more launched wire-tethered electrodes, the housing configured to land within the range of the target to provide the stimulus signal through the target via the two or more wire-tethered electrodes to impede locomotion of the target.

The method of any of the above embodiments, wherein initiating the first launch comprises directing a rapidly expanding gas to launch the two or more wire-tethered electrodes. The method of any of the above embodiments wherein initiating the second launch comprises directing a portion of the rapidly expanding gas used in the first launch to launch the two or more wire-tethered electrodes toward the housing to launch the housing.

A system for aiming a conducted electrical weapon ("CEW") toward a target, the CEW having wire-tethered electrodes configured to be launched toward the target to provide a stimulus signal through the target in a manner to impede locomotion of the target, the system comprising: a rod, oriented in a direction of travel of the wire-tethered electrodes launched from the CEW; a ring coupled to the rod; a camera configured to be oriented along an axis of the rod and panned in a direction to a left and to a right of the axis; wherein: while the CEW is aimed toward the target and the camera is oriented along the axis, the camera is configured to capture an image showing the target near a center of the image with an image of the ring superimposed over the target; and while the CEW is aimed toward the target and the camera is oriented at least one of to the left and to the right of the axis, the camera is configured to capture a showing the target positioned to the right and to the left of the center of the image respectively with the image of the ring superimposed over the target.

The foregoing description discusses implementations (e.g., embodiments), which may be changed or modified without departing from the scope of the present disclosure. Examples listed in parentheses may be used in the alternative or in any practical combination. As used in the specification and illustrative embodiments, the words 'comprising,' 'comprises,' 'includes,' 'having,' and 'has' introduce an open-ended statement of component structures and/or functions. In the specification and illustrative embodiments, the words 'a' and 'an' are used as indefinite articles meaning 'one or more'. In the illustrative embodiments, the term "provided" is used to definitively identify an object that not a claimed or required element but an object that performs the function of a workpiece. For example, in the illustrative embodiment "an apparatus for aiming a provided barrel, the apparatus comprising: a housing, the barrel positioned in the housing", the barrel is not a claimed or required element of the apparatus, but an object that cooperates with the "housing" of the "apparatus" by being positioned in the "housing."

The location indicators "herein," "hereunder," "above," "below," or other word that refer to a location, whether specific or general, in the specification shall be construed to refer to any location in the specification whether the location is before or after the location indicator.

Methods described herein are illustrative examples, and as such are not intended to require or imply that any particular process of any embodiment be performed in the order presented. Words such as "thereafter," "then," "next," etc. are not intended to limit the order of the processes, and these words are instead used to guide the reader through the description of the methods.

The scope of the disclosure is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

What is claimed is:

1. A payload conducted electrical weapon ("CEW") comprising:

a plurality of electrodes;

a communications circuit a signal generator configured to transmit a stimulus signal through the plurality of electrodes; and a housing configured to house the plurality of electrodes, the communications circuit, and the signal generator, wherein the housing is configured to be removably inserted into a bay of a launcher, wherein at least one electrode of the plurality of electrodes is configured to be launched from the housing at a first launch, and wherein the communications circuit is configured to receive a communication signal configured to at least one of launch the at least one electrode, provide the stimulus signal through the at least one electrode while the housing is removably inserted into the bay, and provide a second stimulus signal through the at least one electrode while the housing is removed from the bay.

2. The payload CEW of claim 1 further comprising a power supply positioned in the housing, wherein the power supply is configured to provide an energy to the signal generator for generating the stimulus signal.

3. The payload CEW of claim 1 wherein the housing is configured to be launched from the bay of the launcher at a second launch.

4. The payload CEW of claim 3 wherein the signal generator is configured to provide the stimulus signal to the at least one electrode before, during, and after the housing is launched from the bay of the launcher.

5. The payload CEW of claim 3 wherein the first launch of the at least one electrode and the second launch of the housing are initiated by a single input mechanism.

6. The payload CEW of claim 5 wherein the single input mechanism results in two different discrete outputs, wherein a first discrete output of the two different discrete outputs results in the first launch, and wherein a second discrete output of the two different discrete outputs results in the second launch.

7. The payload CEW of claim 3 further comprising a visual indicator coupled to an outer surface of the housing.

8. The payload CEW of claim 7 wherein the visual indicator is configured to identify the housing for providing the second stimulus signal through the at least one electrode of the plurality of electrodes.

9. A system comprising:

a vehicle;

a launcher coupled to an outer surface of the vehicle; and a payload conducted electrical weapon ("CEW") removably inserted within a bay of the launcher, the payload CEW comprising:

a plurality of electrodes, wherein at least one electrode of the plurality of electrodes is configured to be deployed during a first launch, wherein the first launch occurs after the vehicle is within a range to a target, and wherein the range to the target is determined based on a length of a wire-tether of the at least one electrode of the plurality of electrodes.

10. The system of claim 9 wherein the payload CEW comprises a housing configured to house the plurality of electrodes, wherein the plurality of electrodes are configured to be launched from the housing during the first launch, wherein the housing is configured to be launched from the bay of the launcher during a second launch, and wherein the second launch occurs simultaneously with or after the first launch.

11. The system of claim 10, wherein the launcher is configured to receive a second payload CEW in response to the housing of the payload CEW being launched from the bay of the launcher.

12. The system of claim 9 wherein the launcher comprises a second bay, and wherein the second bay is configured to receive a second payload CEW.

13. The system of claim 9 wherein the vehicle comprises an unmanned aerial vehicle (UAV), an unmanned ground vehicle (UGV), or an unmanned surface vessel (USV).

14. The system of claim 9 wherein the launcher is removably mounted on the vehicle.

15. The system of claim 14 wherein the launcher is removably mounted on the vehicle using a rail interface system.

16. The system of claim 9 wherein the launcher is movably mounted between at least two of the vehicle, a second vehicle, and a weapon.

17. The system of claim 9 wherein the launcher comprises at least one of a camera, a guidance system, a global positioning system, an object detection system, a communications system, a speaker, and a microphone.

18. A payload conducted electrical weapon ("CEW") comprising:

a processor;

a signal generator configured to generate a stimulus signal;

a plurality of wire-tethered electrodes; and a tangible, non-transitory memory configured to communicate with the processor, the tangible, non-transitory memory having instructions stored thereon that, in response to execution by the processor, cause the processor to perform operations comprising:

determining whether the payload CEW is within a range of a target, wherein the range is based on a length of a wire-tether of at least one electrode of the plurality of wire-tethered electrodes, initiating a first launch configured to launch at least two wire-tethered electrodes of the plurality of wire-tethered electrodes toward a target, and instructing the signal generator to provide a first stimulus signal through the target via at least a portion of the at least two wire-tethered electrodes.

19. The payload CEW of claim 18, further comprising a housing configured to house the processor, the signal generator, the plurality of wire-tethered electrodes, and the tangible, non-transitory memory.

20. The payload CEW of claim 19, wherein the operations further comprise initiating a second launch configured to launch the housing, and wherein the at least two wire-tethered electrodes remain coupled to the signal generator before, during, and after the first launch and the second launch.

* * * * *